US007024124B2

(12) United States Patent
Taguchi et al.

(10) Patent No.: US 7,024,124 B2
(45) Date of Patent: Apr. 4, 2006

(54) IMAGE FORMING APPARATUS WHICH DETECTS JAM AND JAM DETECTING METHOD FOR THE SAME

(75) Inventors: Keiichi Taguchi, Nagano-ken (JP); Naoyuki Okumura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 10/735,861

(22) Filed: Dec. 16, 2003

(65) Prior Publication Data

US 2004/0175193 A1 Sep. 9, 2004

(30) Foreign Application Priority Data

Dec. 16, 2002 (JP) ..... 2002-364177
Dec. 27, 2002 (JP) ..... 2002-379388
Jan. 15, 2003 (JP) ..... 2003-006584

(51) Int. Cl.
*G03G 15/00* (2006.01)

(52) U.S. Cl. ..... 399/21; 399/16; 400/708

(58) Field of Classification Search ..... 399/16–21, 399/388–396; 271/258.01, 258.03, 227, 271/259, 265.01, 265.02; 400/605, 708

See application file for complete search history.

(56) References Cited

U.S. PATENT DOCUMENTS 4,084,900 A * 4/1978 Yamaoka et al. ..... 399/21
4,307,957 A * 12/1981 Kitagawa et al. ..... 399/21
5,485,247 A * 1/1996 Morishita et al. ..... 399/16
5,639,171 A * 6/1997 Brewster et al. ..... 400/708
5,970,274 A * 10/1999 Rath ..... 399/21
6,381,441 B1 * 4/2002 Byeon et al. ..... 399/396
2002/0149661 A1 10/2002 Konno

FOREIGN PATENT DOCUMENTS

JP 4-110880 A 4/1992
JP 2858441 B2 2/1999

* cited by examiner

*Primary Examiner*—Minh Chau
(74) *Attorney, Agent, or Firm*—Sughrue Mion, PLLC

(57) ABSTRACT

A reference time ts, which corresponds to a period of time a sheet S needs to move passed a detection position P1 where a sheet detection sensor 841 is disposed, is set in advance in accordance with the length of the sheet S. After a time t1 from the start of driving of a gate roller, as the leading edge of the sheet S transported to a nip area N which is between the heater roller 91 and a pressurizing roller 92 arrives at the detection position P1, an output from the sheet detection sensor 841 changes to an L-level. When the transportation of the sheet has been normal, the sensor output returns to an H-level after a reference time ts or a longer time. On the contrary, upon occurrence of a jam J2 that the sheet S has got wrapped around the heater roller 91, the leading edge of the sheet S moves backward, and therefore, a duration tm in which the sensor output is kept at the L-level becomes shorter than the reference time ts.

12 Claims, 23 Drawing Sheets

FIG. 5

| SHEET SIZE | SHEET LENGTH Ls[mm] | REFERENCE TIME ts[sec] |
|---|---|---|
| A3 | 420 | 3.780 |
| A4 | 297 | 2.673 |
| B4 | 364 | 3.276 |
| B5 | 257 | 2.313 |

$ts = Ls / Vf \times 0.9$

Vf (TRANSPORTATION SPEED) = 100 mm/sec

FIG. 7
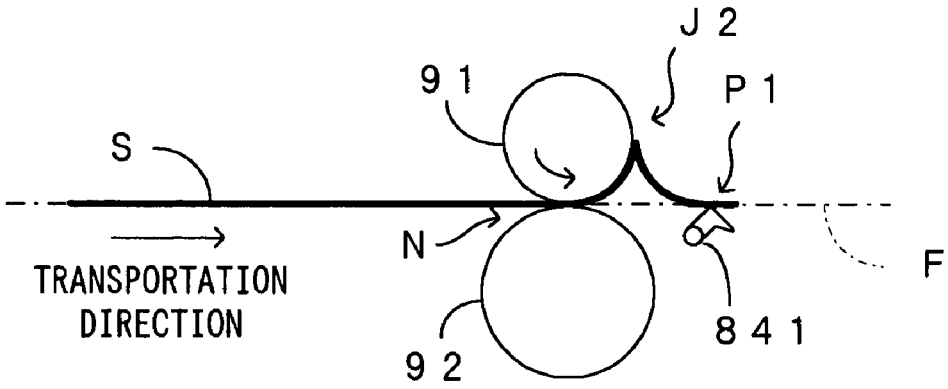
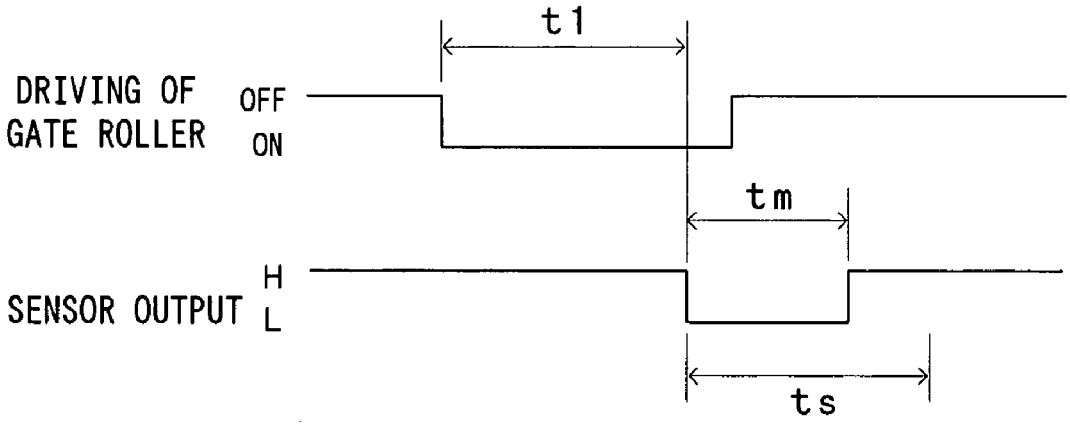

FIG. 16

| | CONDITION FOR APPLICATION | SHEET LENGTH | JAM PATTERN | CONDITION 1 | CONDITION 2 | CONDITION 3 | CONDITION 4 | JUDGEMENT RESULT |
|---|---|---|---|---|---|---|---|---|
| COMPARISON EXAMPLE | SENSORS DISPOSED AT TWO POSITIONS | LONG | A-1 (NORMAL) | — | | | — | ○ |
| | | | A-2 | — | | | ○ | ○ |
| | | | A-3 | ○ | | | — | ○ |
| | | | A-4 | — | | | — | × |
| | CONDITION 1 + CONDITION 4 | SHORT | B-1 (NORMAL) | — | | | — | ○ |
| | | | B-2 | — | | | ○ | ○ |
| | | | B-3 | — | | | — | × |
| | | | B-4 | — | | | — | × |
| PREFERRED EMBODIMENT | SENSORS DISPOSED AT THREE POSITIONS | LONG | A-1 (NORMAL) | — | — | — | — | ○ |
| | | | A-2 | — | — | — | ○ | ○ |
| | | | A-3 | ○ | — | ○ | — | ○ |
| | | | A-4 | — | ○ | — | — | ○ |
| | CONDITION 1 + CONDITION 2 + CONDITION 3 + CONDITION 4 | SHORT | B-1 (NORMAL) | — | — | — | — | ○ |
| | | | B-2 | — | — | — | ○ | ○ |
| | | | B-3 | — | — | ○ | — | ○ |
| | | | B-4 | — | ○ | — | — | ○ |

IMAGE FORMING APPARATUS WHICH DETECTS JAM AND JAM DETECTING METHOD FOR THE SAME

BACKGROUND OF THE INVENTION

1. Field of the Invention

The present invention relates to a technique for detecting a jam of a recording medium in an image forming apparatus.

2. Description of the Related Art

In an image forming apparatus such as a printer, a copier machine and a facsimile machine, transportation means is disposed which transports a recording medium such as a paper and an OHP sheet along a predetermined transportation path. The transportation means generally has such a structure in which a recording medium is firmly held between a rotating member, such as a roller and a belt, and a roller. As the rotating member rotates in a predetermined direction, the recording medium is transported in the predetermined direction.

Such transportation means accompanies a jam, i.e., a phenomenon that a recording medium fails to be normally transported and instead gets wrapped around a roller or the like, which could damage not only the recording medium but the apparatus itself. Particularly in a fixing unit for heating and pressurizing a recording medium to which a toner image has been transferred and accordingly fixing the toner image, since a fixing roller which serves as transportation means also heats up a recording medium, the recording medium can easily get wrapped because of curling of the recording medium or molten toner. In an effort to prevent a jam-induced damage to the apparatus, a number of jam detecting techniques for immediately sensing a jam upon occurrence of the jam have been proposed.

FIGS. 1A and 1B are principle drawings which show one example of a jam detection according to a conventional technique. The jam detecting technique illustrated in FIGS. 1A and 1B is a technique for detecting a jam of a recording medium at a fixing roller in an image forming apparatus described in Japanese Patent No. 2,858,441. According to the jam detecting technique, as shown in FIG. 1A, there are sensors disposed one ahead of and the other behind a fixing roller R on a transportation path FF, that is, there are a paper feed sensor Sa ahead of the fixing roller R and a paper discharge sensor Sb behind the fixing roller R. Occurrence of a jam is detected from the timing of changes of outputs from these sensors. These sensors Sa and Sb are each for sensing whether there is a recording medium SS such as a paper at the position of the sensor, and output an L-level when there is a recording medium there but an H-level when there is not a recording medium there.

During normal transportation of the recording medium SS along the transportation path FF from the left-hand side in FIG. 1A, the output from the paper feed sensor Sa changes to the L-level upon arrival of the leading edge of the recording medium SS at the paper feed sensor Sa but to the H-level upon arrival of the trailing edge of the recording medium SS at the paper feed sensor Sa. Meanwhile, the output from the paper discharge sensor Sb changes similarly to the output from the paper feed sensor Sa, with a certain delay in time. On the contrary, in the event that the recording medium SS gets wrapped around the fixing roller R as denoted at the reference symbol J in FIG. 1B, the leading edge of the recording medium SS moves backward, and the output from the paper discharge sensor Sb changes to the H-level before the output from the paper feed sensor Sa does. Therefore, in such an instance, that is, when the output from the paper discharge sensor changes the H-level before the output from the paper feed sensor changes to the H-level, driving of the fixing roller R is immediately stopped, determining that a jam has occurred.

However, the conventional technique described above has the following problem. According to this technique, since occurrence of a jam is determined only in accordance with which one of the two sensor outputs changes before the other one does, it is not possible to detect occurrence of a jam which has taken place after the trailing edge of the recording medium SS has moved passing the position of the paper feed sensor. In addition, the arrangement of the sensors imposes a restriction upon the size of the recording medium with which it is possible to detect a jam. That is, as for a recording medium which is shorter than the length of the transportation path between the two sensors (i.e., the length La+Lb shown in FIG. 1A), since the paper feed sensor output returns to the H-level before the paper discharge sensor output changes to the L-level, it is not possible to detect a jam which occurs later than this by the method described above.

SUMMARY OF THE INVENTION

A major object of the present invention is to provide an image forming apparatus which can securely detect a jam of a recording medium occurring at transportation means and a jam detecting method for such an apparatus, in order to solve the problem above. To achieve this objective, according to the present invention, a jam of a recording medium is detected without fail in the following manner using detection means which outputs a predetermined signal in accordance with whether the recording medium has moved passing the detection means or not.

In a first aspect of the present invention, one detection means disposed behind transportation means is used, and whether there is a jam or not is determined based on the duration of an output signal from the detection means.

A second aspect of the present invention uses three detection means in total, one disposed ahead of the transportation means and the two disposed behind the transportation means. Whether there is a jam or not is determined based on changes of output signals from these.

A third aspect of the present invention uses two detection means in total which are disposed behind the transportation means, and whether there is a jam or not is determined based on changes of output signals from these. This is effective particularly to detection of a jam within an apparatus which forms images on the both surfaces of a recording medium.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 5 is a table which shows the reference time for each sheet size;

FIG. 7 is a drawing which shows another example of how a sheet can get wrapped around the heater roller;

FIG. 16 is a drawing which compares a jam judgment result in this embodiment and that in the image forming apparatus of the comparison example;

DETAILED DESCRIPTION OF THE PREFERRED EMBODIMENTS

<First Preferred Embodiment>

Figure 1A:
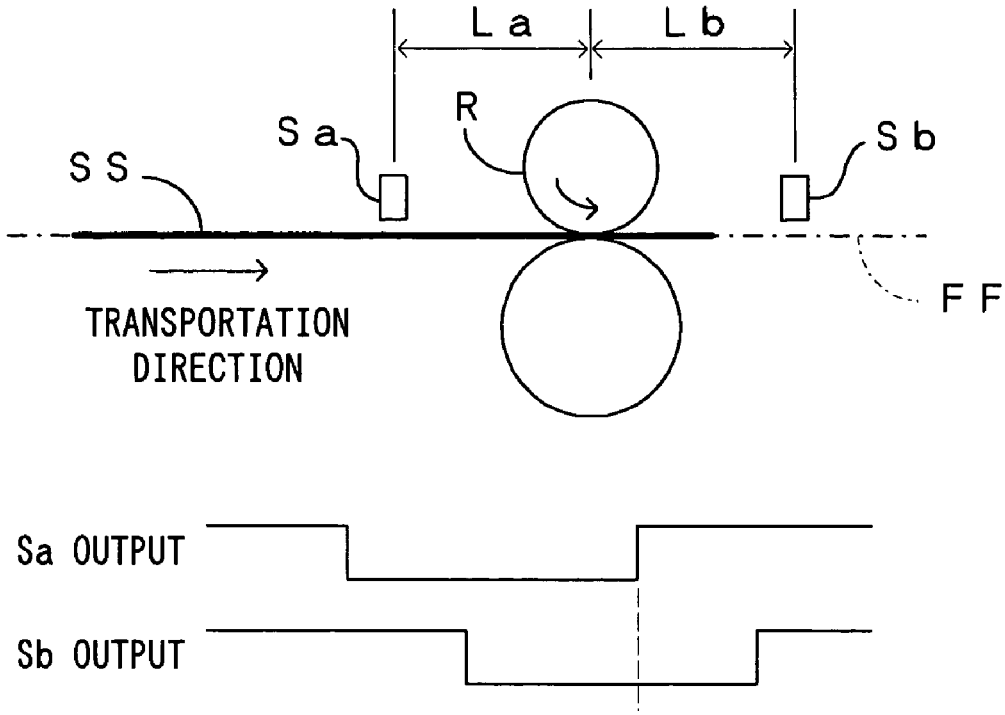
FIGS. 1A and 1B are principle drawings which show one example of a jam detection according to a conventional technique.
Figure 1B:
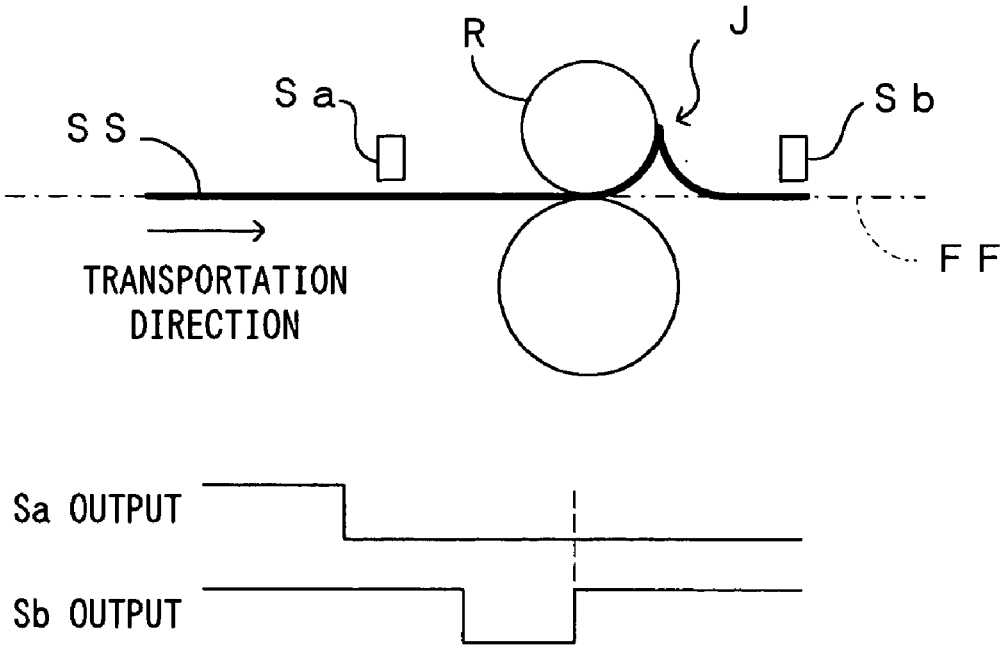
Figure 2:
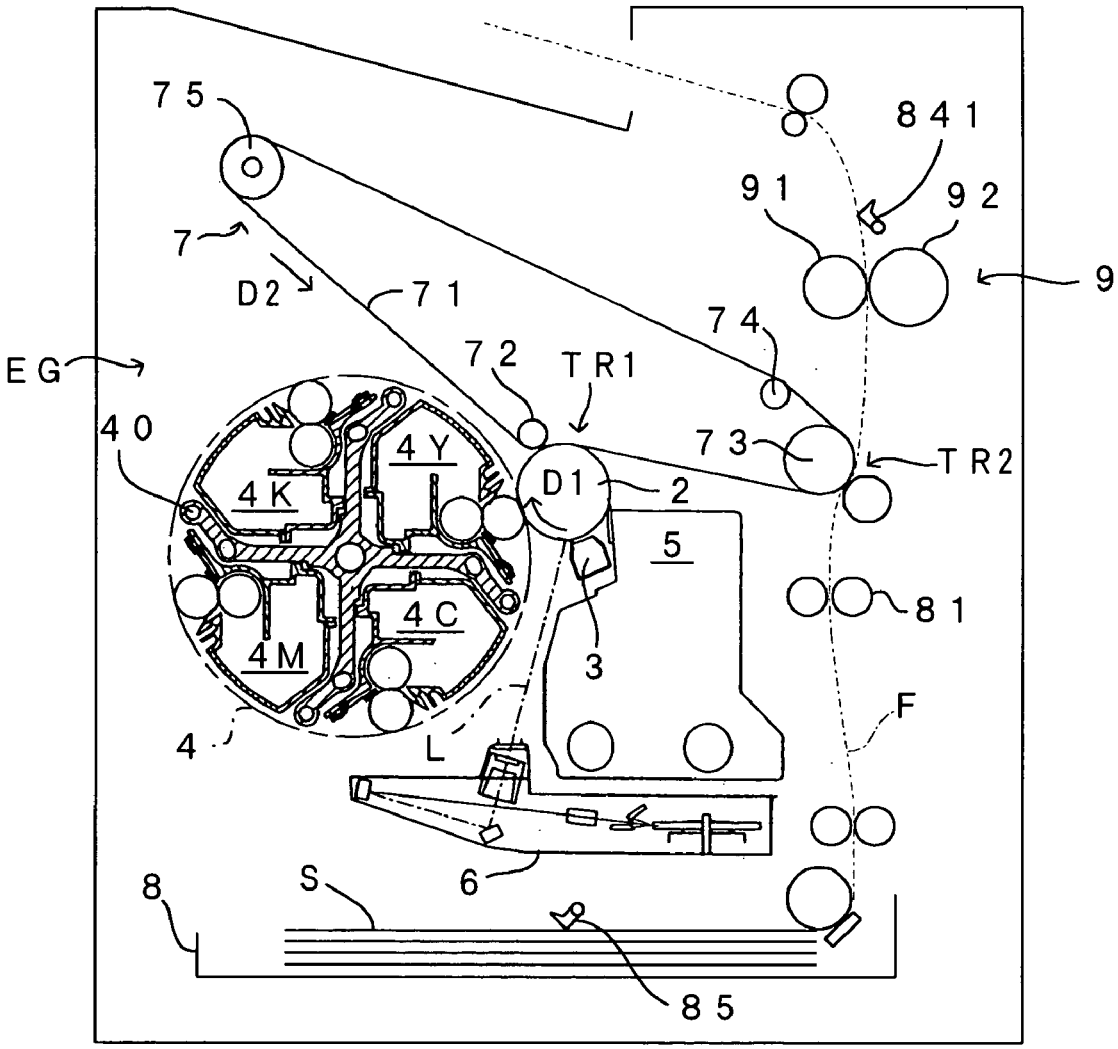
FIG. 2 is a drawing which shows a first preferred embodiment of an image forming apparatus according to the present invention.
Figure 3:
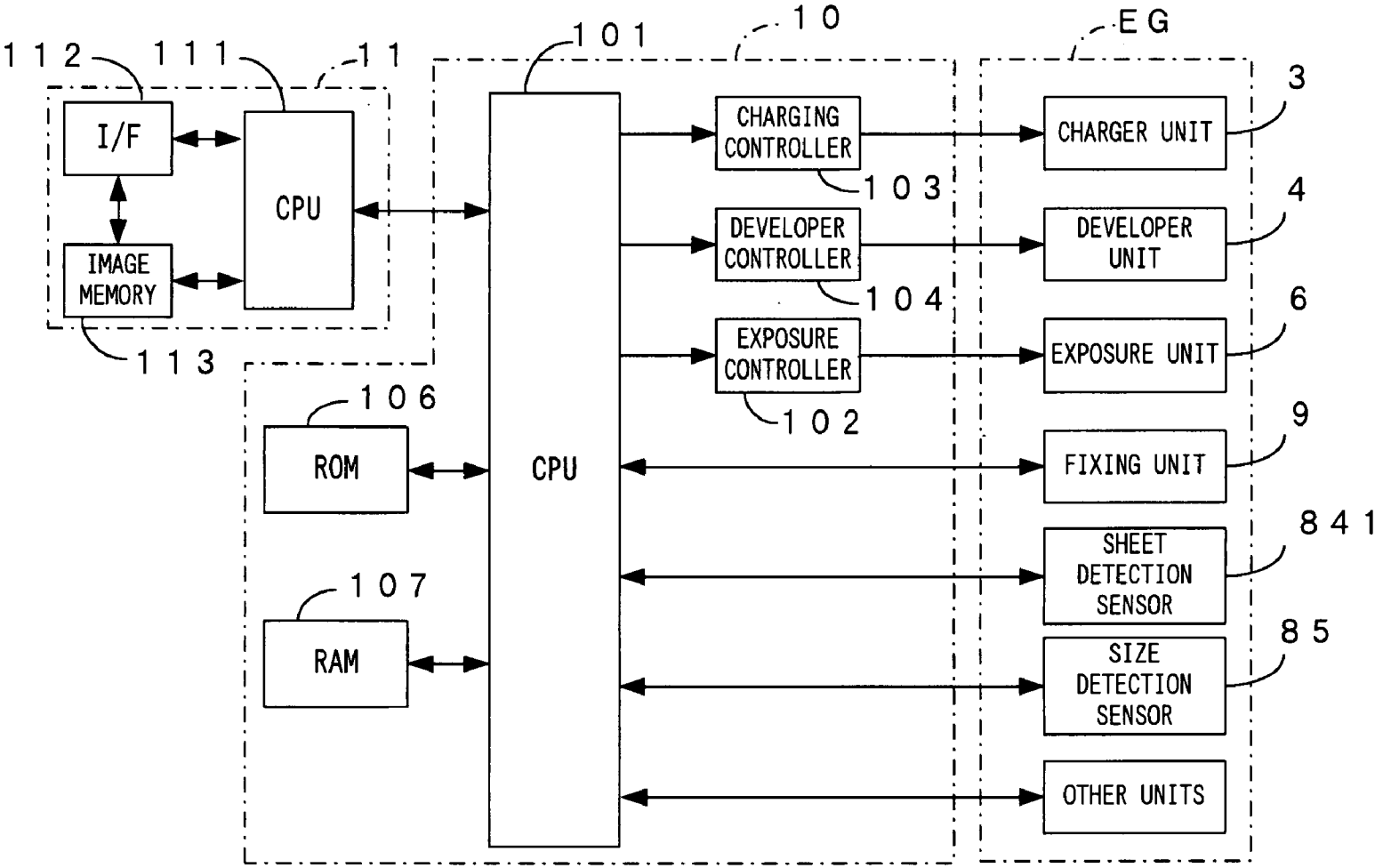
FIG. 3 is a block diagram which shows an electric structure of the image forming apparatus shown in FIG. 2.

FIG. 2 is a drawing which shows a first preferred embodiment of an image forming apparatus according to the present invention. FIG. 3 is a block diagram which shows an electric structure of the image forming apparatus shown in FIG. 2. This apparatus is an image forming apparatus which superimposes toner in four colors of yellow (Y), cyan (C), magenta (M) and black (K) to thereby form a full color image or forms a monochrome image using black (K) toner alone. In this image forming apparatus, as an image signal is fed to a main controller 11 from an external apparatus such as a host computer, an engine controller 10 controls the respective portions of an engine EG in accordance with a command from the main controller 11, whereby an image corresponding to the image signal is formed on a sheet S.

In the engine EG, a photosensitive member 2 is disposed in such a manner that the photosensitive member 2 can freely rotate in the arrow direction D1 shown in FIG. 2. Disposed around the photosensitive member 2 are a charger unit 3, a rotary developer unit 4 and a cleaning unit 5 along the rotation direction D1 of the photosensitive member 2. The charger unit 3 is provided with a charging bias from a charging controller 103, and uniformly charges up an outer circumferential surface of the photosensitive member 2 to a predetermined surface potential.

An exposure unit 6 irradiates a light beam L upon the outer circumferential surface of the photosensitive member 2 which is charged up by the charger unit 3. Exposing the photosensitive member 2 with the light beam L in accordance with a control command fed from an exposure controller 102, the exposure unit 6 forms an electrostatic latent image corresponding to the image signal. For instance, as the image signal is fed to a CPU 111 of the main controller 11 via an interface (I/F) 112 from an external apparatus such as a host computer, a CPU 101 of the engine controller 10 outputs a control signal corresponding to the image signal to the exposure controller 102. The exposure unit 6 irradiates the light beam L upon the photosensitive member 2 in response to this, whereby an electrostatic latent image corresponding to the image signal is formed on the photosensitive member 2.

The rotary developer unit 4 develops thus formed electrostatic latent image. The rotary developer unit 4 comprises a support frame 40 which is axially disposed for free rotations, a rotation driver which is not shown in the drawing, and a yellow developer 4Y, a cyan developer 4C, a magenta developer 4M and a black developer 4K which can be attached to and detached from the support frame 40 and which hold toner of the respective colors. A developer controller 104 controls the rotary developer unit 4, as shown in FIG. 3. Based on a control command from the developer controller 104, the rotary developer unit 4 is driven into rotations and selected one of the developers 4Y, 4C, 4M and 4K is positioned to a developing position facing the photosensitive member 2, so that the toner of the selected color is applied upon the surface of the photosensitive member 2. As a result, the electrostatic latent image on the photosensitive member 2 is visualized in the selected color.

The toner image developed by the rotary developer unit 4 in the manner described above is primarily transferred onto an intermediate transfer belt 71 of a transfer unit 7, within a primary transfer area TR1. The transfer unit 7 comprises the intermediate transfer belt 71 which runs across a plurality of rollers 72 through 75 and a driver (not shown) which drives the roller 73 into rotations and accordingly rotates the intermediate transfer belt 71 into rotations in a predetermined rotation direction D2. Toner images in the respective colors formed on the photosensitive member 2 are superimposed one atop the other on the intermediate transfer belt 71. The image obtained by the superimposition is secondarily transferred on a sheet S which is a "recording medium" which is ejected out from a cassette 8 and transported along a transportation path F to a secondary transfer area TR2.

At this stage, in order to correctly transfer the image on the intermediate transfer belt 71 to a predetermined position on the sheet S, the timing of sending the sheet S to the secondary transfer area TR2 is managed. To be more specific, there is a gate roller 81 disposed ahead of the secondary transfer area TR2 on the transportation path F. As the gate roller 81 rotates in synchronization to the timing at which the intermediate transfer belt 71 rotates, the sheet S is sent to the secondary transfer area TR2 at predetermined timing.

The sheet S on which the color image has been thus formed is transported to a discharge tray part, which is disposed to a top surface portion of a main section of the apparatus, via a fixing unit 9. The structure and function of the fixing unit 9 will be described in detail later.

At a position behind the fixing unit 9 on the transportation path F, there is a sheet detection sensor 841 which is formed by a micro switch or a photo-interrupter for instance. The sheet detection sensor 841 is structured so as to output a low(L)-level signal when there is the sheet S present at this position (detection position) but a high(H)-level signal when there is no sheet S, and thus functions as "first detection means" of the present invention. Further, the cassette 8 comprises a size detection sensor 85 which judges the size of the sheet S. This apparatus is capable of forming an image on a sheet S whose size is either one of A3, A4, B4 and B5 which are defined by Japanese Industrial Standards. Based on an output from the size detection sensor 85, the CPU 101 can judge which size of the sheet is set to the cassette 8.

In FIG. 3, denoted at 113 is an image memory which is disposed to the main controller 11 to store an image fed via the interface 112 from an external apparatus such as a host computer. Denoted at 106 is a ROM which stores a calculation program executed by the CPU 101, control data for controlling the engine part EG, etc. Denoted at 107 is a RAM which temporarily stores the result of a calculation performed by the CPU 101 and other data.

Figure 4A:
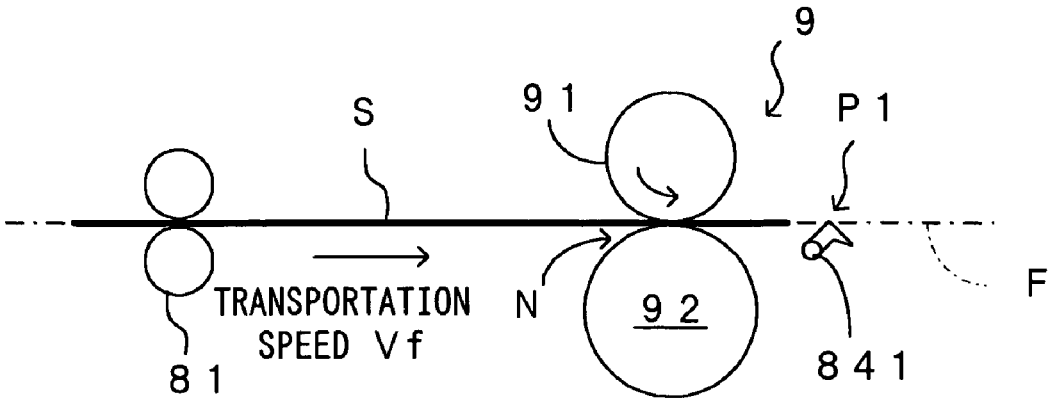
FIG. 4A is a drawing which shows the fixing unit of this image forming apparatus.
Figure 4B:
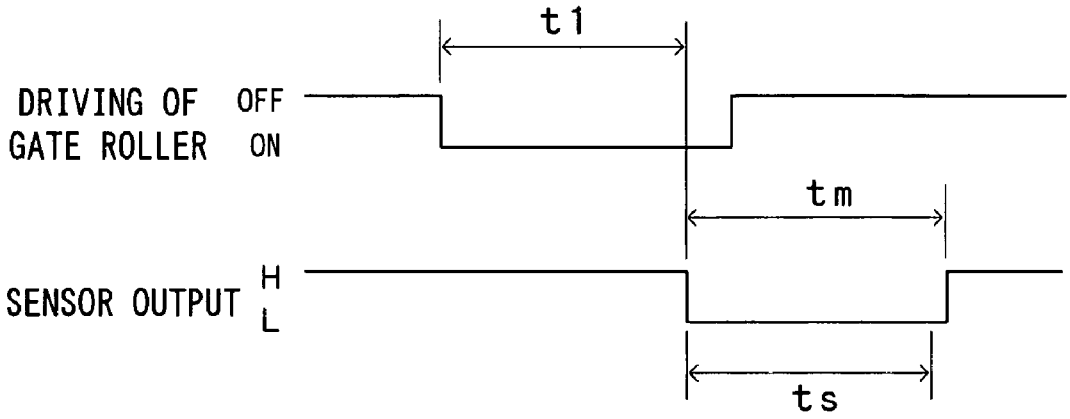
FIG. 4B is a timing chart showing an example of changes of an output from the sheet detection sensor.

FIG. 4A is a drawing which shows the fixing unit of this image forming apparatus. FIG. 4B is a timing chart showing an example of changes of an output from the sheet detection sensor. As shown in FIG. 4A, the fixing unit 9 comprises a heater roller 91 and a pressurizing roller 92. Heated up to a predetermined temperature by a heater which is not shown in the drawing, the heater roller 91 heats up toner which constitutes a toner image which has been transferred onto a sheet S. The pressurizing roller 92 is obtained by wrapping an elastic member, such as silicone rubber, around a metal roller core, and is disposed so as to contact and pressurize the heater roller 91 on the sheet transportation path F. As a sheet S to which a toner image has been transferred is transported along the sheet transportation path F from the left-hand side in FIG. 4A, a driver not shown in the drawing drives the heater roller 91 into rotations in the direction of the arrow in FIG. 4A. Hence, the sheet S guided to a nip area N between the heater roller 91 and the pressurizing roller 92 is sent toward the right-hand side while firmly held between the two rollers 91 and 92. At this stage, the toner on the sheet S is subjected to heat and pressure, so that the toner fuses to the sheet S and an image is fixed. In this embodiment, the fixing unit 9 is "transportation means" which transports a sheet S along the sheet transportation path F, and at the same time, functions also a "fixing unit" which fixes a yet-to-be-fixed image on a sheet S.

When the leading edge of a sheet S sent out from the fixing unit 9 reaches a detection position P1 (first detection position) at which the sheet detection sensor 841 is disposed, an output signal from the sensor 841 changes from the H-level to the L-level. As described earlier, the sheet S starts moving toward the secondary transfer area TR2 as the gate roller 81 rotates. Hence, as shown in FIG. 4B, after a certain period of time t1 from turning on of the gate roller 81, the output from the sensor 841 changes to the L-level.

After the trailing edge of the sheet S has moved passing the detection position P1, the output from the sensor 841 returns to the H-level. In this embodiment, the L-level output from the sensor 841 corresponds to a "first detection signal" of the present invention. The CPU 101 measures and stores the duration of this detection signal, namely, a period tm during which the sensor output is maintained at the L-level. The duration tm naturally has a different value depending on the length of a sheet S or the speed at which the sheet S is transported. The flip side of this is that it is possible to predict the duration tm when the length of a sheet S and the transportation speed Vf of the sheet are known. As long as a sheet S is being normally transported, the actual duration tm must approximately coincide with the predicted value.

On the other hand, in the event that the actually measured duration tm is considerably different from the predicted value, something abnormal must have happened during the transportation of the sheet, i.e., a jam must have occurred. In a device like the fixing unit 9 wherein a rotating member such as a roller and a belt comes into contact with a sheet S and the sheet S is transported, the sheet S easily gets wrapped around the rotating member. Particularly in the fixing unit 9, a sheet S may curl up because of the heat from the heater roller 91 or adhere to a surface of the heater roller 91 through molten toner in some cases. Thus, the sheet S tends to get wrapped around the heater roller 91.

A sheet S could get wrapped around the heater roller 91, starting at the leading edge of the sheet S or in the middle of the sheet S. In this embodiment, for the purpose of quickly detecting a jam attributed to the wrapping, a reference time ts shown in FIG. 5 is set for each one of mutually different sheet sizes, the actual time tm which a sheet took to move passed the detection position is compared with the reference time ts, and whether a jam has occurred or not is determined.

FIG. 5 is a table which shows the reference time for each sheet size. The reference time ts is calculated by the following formula:

$$ts = Ls/Vf \times 0.9.$$

The symbol Ls denotes the length of a sheet S along the transportation direction. The symbol Vf denotes the sheet transportation speed in the fixing unit 9 which is a constant value of 100 mm/sec in the illustrated example. When a sheet having other size is used or the transported sheet is directed differently from this, the sheet length Ls may be set accordingly. Further, when the transportation speed is different from this or the single apparatus is equipped with a plurality of operation modes such as a high-speed mode and a low-speed mode which use different transportation speeds from each other, the value Vf may be appropriately changed in accordance with the transportation speed.

With the sheet length Ls divided by the transportation speed Vf, a time which a sheet S needs to move passed the detection position Pt is predicted. Yet, the actual passing time could be slightly different from the predicted value, owing to variations of the sheet length, the transportation speed and the like. Noting this, the difference is estimated to be maximum of 10%, and 90% of the value Ls/Vf is defined as the reference time ts. The reference time ts shown in FIG. 5 is a value which is thus calculated for each size. While the reference time ts is calculated on the assumption that variations of the passing time for the respective sizes are uniformly 10%, this is not limiting. For instance, the reference time ts may be calculated by subtracting a certain value from the value Ls/Vf which is calculated for each size. Alternatively, the reference time ts may be calculated by other appropriate method in accordance with the material of sheets S, the transportation speed of sheets S, etc.

Referring to FIG. 4B again, normal transportation of a sheet S will now be considered. In this instance, the time tm which the sheet S actually took to move passed the detection position P1 must be equal to or longer than the reference time ts. This is because the reference time ts has been set for each sheet size so as to be the minimum necessary time for the sheet S to actually move passed the detection position P1, as described above. Hence, when the duration tm during which the sensor output remains at the L-level is equal to or longer than the reference time ts, it then follows that the sheet S has been normally transported. On the contrary, when the sheet S has got wrapped around the heater roller 91, the sensor output behaves differently from this.

Figure 6A:
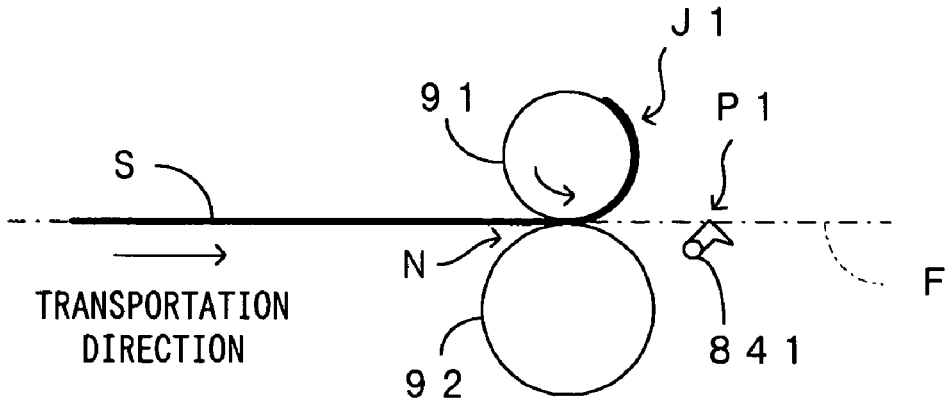
FIG. 6A is a drawing which shows an example of how a sheet can get wrapped around the heater roller.
Figure 6B:
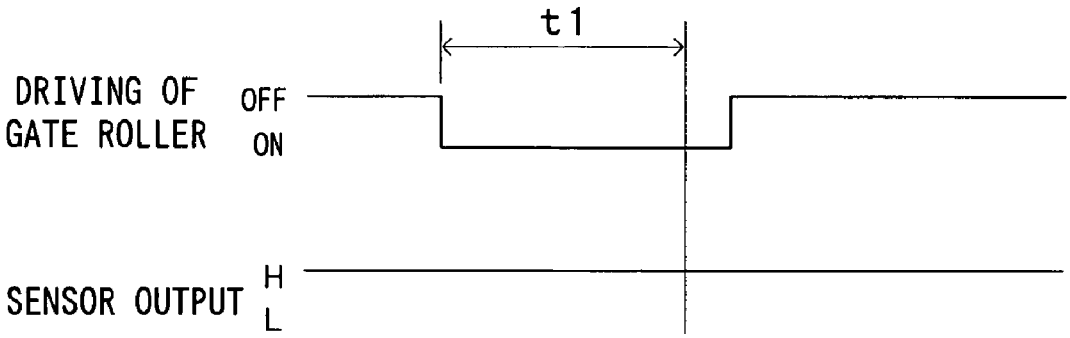
FIG. 6B is a timing chart showing an example of changes of an output from the sheet detection sensor.

FIG. 6A is a drawing which shows an example of how a sheet can get wrapped around the heater roller. FIG. 6B is a timing chart showing an example of changes of an output from the sheet detection sensor. As shown in FIG. 6A, upon occurrence of a jam J1 that a sheet S gets wrapped around the heater roller 91 at the leading edge of the sheet S, the leading edge of the sheet S will not reach the detection position P1. Because of this, as shown in FIG. 6B, even after the certain period of time t1 from turning on of the gate roller 81, the output from the sheet detection sensor 841 remains at the H-level. When the sensor output fails to change to the L-level even after the certain period of time t1 from the start of driving of the gate roller 81 therefore, the CPU 101 determines that a jam has occurred. The sheet S does not reach the detection position P1 also when there is a jam at the gate roller 81 or in the secondary transfer area TR2, and hence, the sensor output similarly stays at the H-level. It is therefore possible to securely detect a jam occurring anywhere between the gate roller 81 and the fixing unit 9 in the manner described above. This is not limited only to wrapping around of the sheet S at the leading edge of the sheet S shown in FIG. 6A but also includes wrapping around which takes place before the leading edge of the sheet S arrives at the detection position P1 after moving passed the nip area N.

FIG. 7 is a drawing which shows another example of how a sheet can get wrapped around the heater roller. An instance that a sheet S gets wrapped around the heater roller 91 in the middle of the sheet S as shown in FIG. 7 will now be considered. The fixing unit 9 is particularly prone to a jam J2 of this type. The reason is that peripheral portions are vacant in many images and particularly in such images which are mostly text and almost no toner is present in a leading edge portion of a sheet S, whereas in inner portions, there is adhering toner and the sheet S is more likely to stick to the heater roller 91. Upon occurrence of the jam J2, the heater roller 91 winds up a sheet S and the sheet S has once moved backward although the leading edge of the sheet S moves passed the detection position P1, and the sheet S eventually departs from the detection position P1. Hence, the output from the sheet detection sensor 841 returns to the H-level without waiting for the reference time ts as shown in FIG. 7. In other words, the duration tm is shorter than the reference time ts at this stage. Noting this, the CPU 101 determines that a jam has occurred in the fixing unit 9, when the measured duration tm is shorter than the predetermined reference time ts. In this manner, the CPU 101 functions as "jam judging means" which measures the duration tm of the detection signal and judges whether a jam has occurred based on the value tm in this embodiment.

As described above, in this embodiment, the sheet detection sensor 841 which is disposed behind the fixing unit 9 on the sheet transportation path F measures the duration tm of the detection signal which is indicative of the presence of a sheet S. When the duration tm is shorter than the reference time ts which has been set in accordance with the size of the sheet S, it is determined that a jam has occurred. In this fashion, whichever size a sheet S has, it is possible to detect occurrence of a sheet jam without fail. In addition, it is not necessary to dispose a plurality of sensors, and instead, it is possible to detect a jam using one sensor.

To set the reference time ts, it is necessary to grasp the length along the sheet transportation path F of a sheet S which is to be fed to the fixing unit 9. Various methods of identifying the length of the sheet S may be used. For example, according to the preferred embodiment above, the CPU 101 judges the book size of the sheet S which is set to the cassette 8 based on an output signal from the size detection sensor 85, and the specification length value for this book size is used as the length of the sheet S. In short, the size detection sensor 85 functions as "length detection means" of the present invention in this embodiment.

Applicable as other method of grasping the length of a sheet S is a method which is based on a control command fed from an external apparatus. That is, since a control command fed from an external apparatus generally contains some information which specifies the size of an image, the size of a sheet to use and the like, it is possible to grasp the size of a sheet based on this information.

Still other method may be a method which requires to dispose the length detection means on the forward side to the fixing unit 9 along the sheet transportation path F and measure the length of a transported sheet S. For instance, a sensor having a similar structure to that of the sheet detection sensor 841 is disposed on the forward side to the fixing unit 9 on the sheet transportation path F, and the actual time which the sheet S takes to move passed a detection position of this sensor is measured. The length of the sheet S can be estimated from thus measured passing time. In this case, the length of the sheet S may be calculated from thus measured passing time and the reference time ts may be set in accordance with this result, or alternatively, the reference time ts may be determined directly from the measured passing time. In particular, in the event that the transportation speed of a sheet S as it moves passed one sensor is the same as that of the sheet S as it moves passed the other sensor, a time which the sheet S would need to move passed the nip area N is estimated to be approximately equal to the measured result described above. Hence, a variation may be added to the measured time and the resultant value may be used as the reference time ts. In this embodiment, the size detection sensor 85 can be used also for this purpose, or alternatively, a sensor separately disposed on the sheet transportation path F can be used for this purpose.

<Second Preferred Embodiment>

A second preferred embodiment of the image forming apparatus according to the present invention will now be described. As described above, although it is possible to detect a jam using one sheet detection sensor according to the first preferred embodiment, the first preferred embodiment requires that the size of a sheet is known in advance. On the other hand, in the second preferred embodiment of the image forming apparatus according to the present invention described below, since a jam is detected using outputs from three sheet detection sensors, it is possible to detect a jam without fail even when the size of a sheet is unknown.

Figure 8:
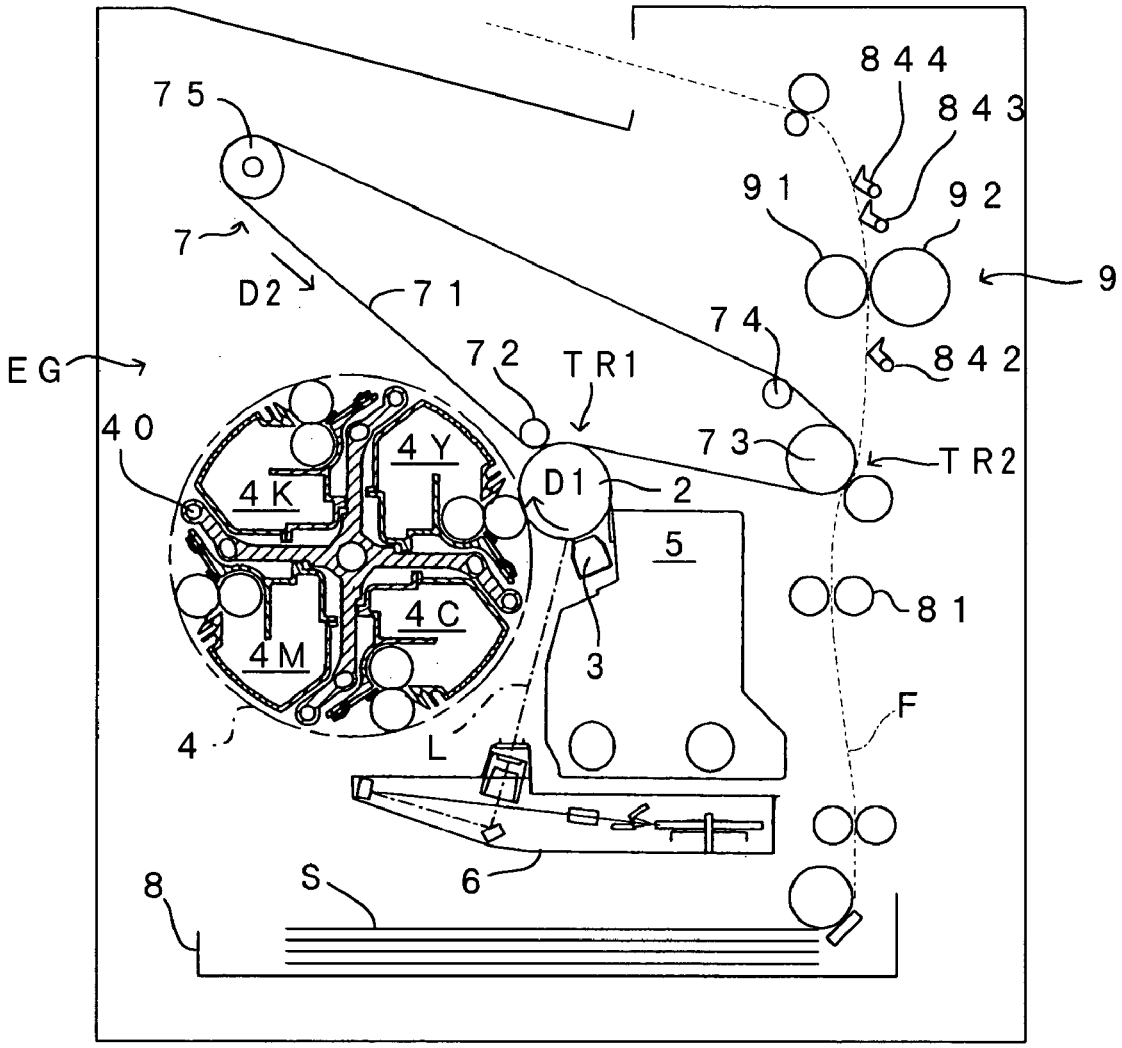
FIG. 8 is a drawing which shows the second preferred embodiment of the image forming apparatus according to the present invention.

FIG. 8 is a drawing which shows the second preferred embodiment of the image forming apparatus according to the present invention. As compared with the apparatus of the first preferred embodiment shown in FIG. 2, in the apparatus of the second preferred embodiment, the sheet detection sensor 841 is replaced with three sensors 842, 843 and 844, and the size detection sensor 85 is omitted.

The size detection sensor is omitted in the apparatus of the second preferred embodiment, because it is not always necessary to learn about the size of a sheet for detection of a jam in this embodiment as described later. However, the sheet detection sensor can be used for other purposes such as to notify an external apparatus of the size of sheets S which are housed in the cassette 8 and check the remaining amount of the sheets, and hence, the sheet detection sensor may be used in this embodiment for these purposes of course.

As shown in FIG. 8, on the sheet transportation path F, the second sensor 842 is disposed ahead of the fixing unit 9 along the sheet transportation direction and the third sensor 843 is disposed behind the fixing unit 9 along the same direction while the fourth sensor 844 is disposed behind the third sensor 843. The sensors 842 through 844 are structured so as to output the L-level when there are sheets S present at their positions (detection positions) but the H-level signal when there is no sheet 5, and these outputs are supplied to the CPU 101. In this embodiment, the sensors 842 through 844 function as "first through third detection means" of the present invention.

Owing to the differences between the positions of the sheet detection sensors, a jam detecting method used in the apparatus of the second preferred embodiment is different from that used in the apparatus of the first preferred embodiment. Other structures and basic operations of the apparatus are similar to those of the apparatus of the first preferred embodiment described earlier, and therefore, the same structures will not be described but denoted at the same reference symbols.

Figure 9A:
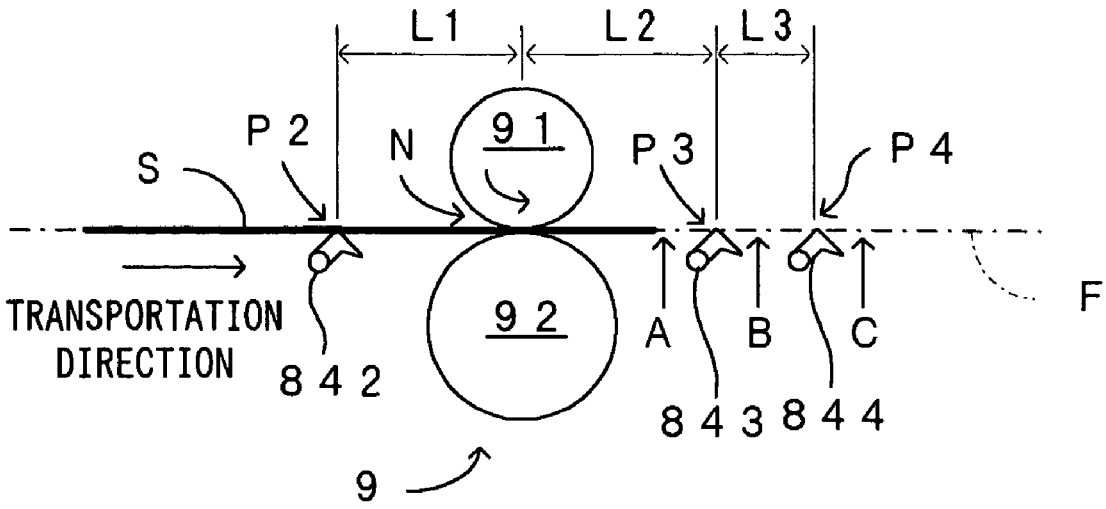
FIG. 9A is a drawing which shows a section around the fixing unit of the second preferred embodiment.

FIG. 9A is a drawing which shows a section around the fixing unit of the second preferred embodiment. Of the three sheet detection sensors which detect whether there is a sheet S, the second sensor 842 detects whether there is a sheet S at a position P2 which is on the sheet transportation path F and ahead of the fixing unit 9 in the sheet transportation direction. The third sensor 843 detects whether there is a sheet S at a position P3 which is on the sheet transportation path F and behind the fixing unit 9 in the sheet transportation direction. The fourth sensor 844 detects whether there is a sheet S at a position P4 which is on the sheet transportation path F and behind the position P3. In this embodiment, the positions P2, P3 and P4 correspond respectively to a "first detection position," a "second detection position" and a "third detection position" of the present invention.

As shown in FIG. 9A, the gap between the second detection position P2 and the nip area N is L1, the gap between the nip area N and the third detection position P3 is L2, and the gap between the third detection position P3 and the fourth detection position P4 is L3. Although the sheet transportation path F is shown as a straight path in FIG. 9A, the sheet transportation path F is curved in reality as shown in FIG. 8. Hence, the gap between the two positions mentioned above is the length of the sheet transportation path F whose both ends are these two positions. Further, the gap L3 between the third detection position P3 and the fourth detection position P4 is shorter than the length along transportation direction of the shortest sheets S which can be transported on the sheet transportation path F in this apparatus. Such a structure is easily realized by disposing the third sensor 843 and the fourth sensor 844 close to each other, because although it is difficult to shorten the gap between the second sensor 842 and the third sensor 843 beyond a certain extent since there is the fixing unit 9 between these two sensors, there is no such structure disposed between the third sensor 843 and the fourth sensor 844.

Figure 9B:
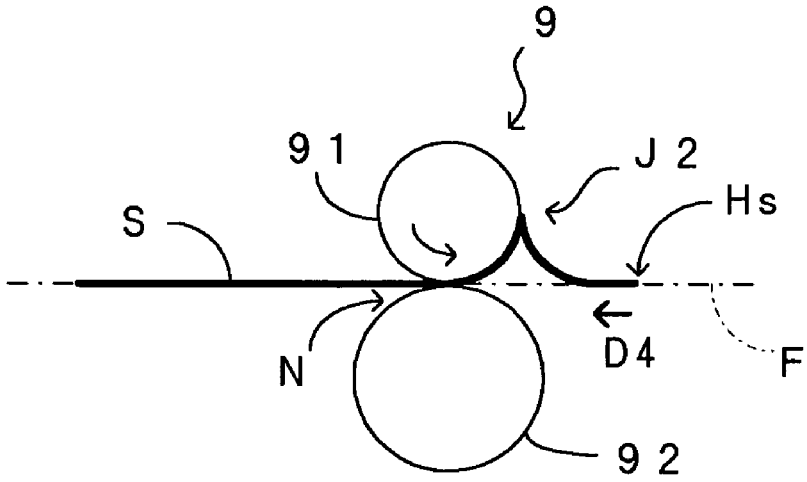
FIG. 9B is a drawing which shows an example how a sheet gets wrapped around the heater roller.

FIG. 9B is a drawing which shows an example how a sheet gets wrapped around the heater roller. As shown in FIG. 9B, upon occurrence of the jam J2 that a sheet S gets wrapped around the heater roller 91, the heater roller 91 winds up the sheet S and the leading edge Hs of the sheet S moves toward the left-hand side in FIG. 9B, i.e., along the direction of the arrow D4 although the leading edge Hs of the sheet S is supposed to move toward the right-hand side in FIG. 9B.

In consequence, the three sensor output signals which change one after another as the sheet S moves change in a different pattern between an instance where the sheet S is normally transported and an instance where there is the jam J2. The pattern of the changes becomes different also depending on the length of the sheet S and the location of the sheet S upon occurrence of the jam J2. Noting this, the length Ls of a sheet S along transportation direction and the location of the sheet leading edge Hs upon occurrence of a jam are classified as described below, and how the output signal from each sensor changes will now be described in relation to each combination of these two.

The sheet length Ls:

(A) $Ls \geqq (L1+L2)$; and (B) $Ls < (L1+L2)$.

The location of the sheet leading edge Hs upon occurrence of a jam:

(1) A sheet S has been normally transported (no jam);

(2) A jam has occurred when the sheet leading edge Hs has located between the nip area N and the position P3 (i.e., at the position A in FIG. 9A);

(3) A jam has occurred the sheet leading edge Hs has located between the position P3 and the position P4 (i.e., at the position B in FIG. 9A); and (4) A jam has occurred the sheet leading edge Hs has located behind the position P4 (i.e., at the position C in FIG. 9A).

Figure 10A:
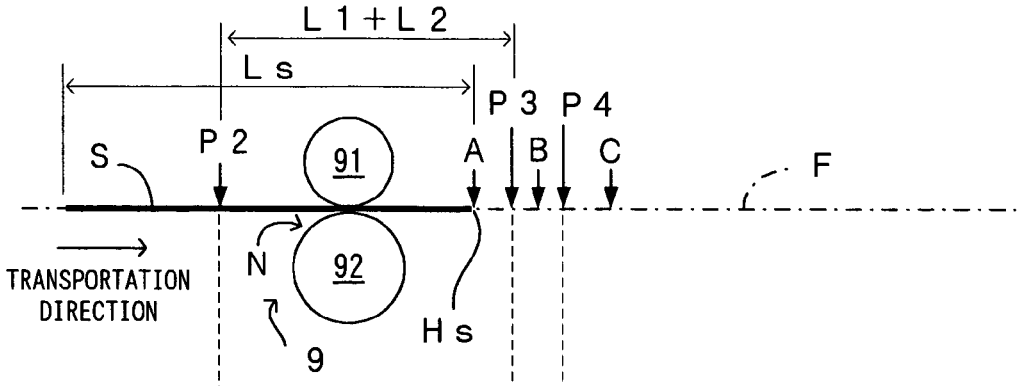
FIGS. 10A and 11A are drawings which show a positional relationship at the time of occurrence of a jam in the event that the length Ls of a sheet S is longer than the gap between the positions P2 and P3.
Figure 10B:
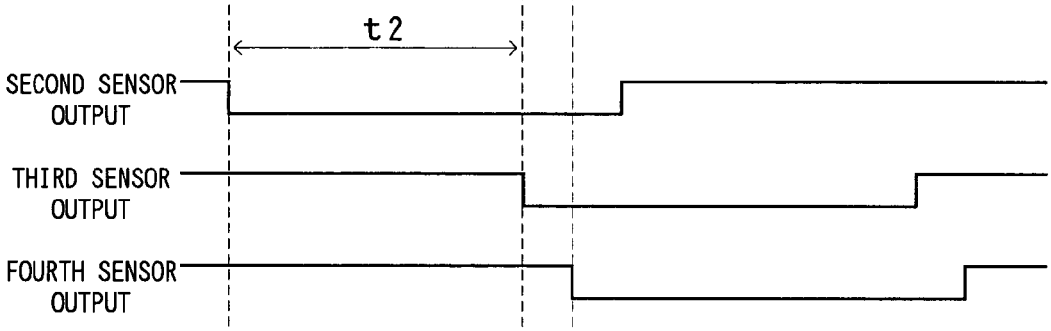
FIGS. 10B, 10C, 11B, 11C, 12B, 12C, 13B and 13C are drawings which show examples of the change pattern of the three sensor outputs.
Figure 10C:
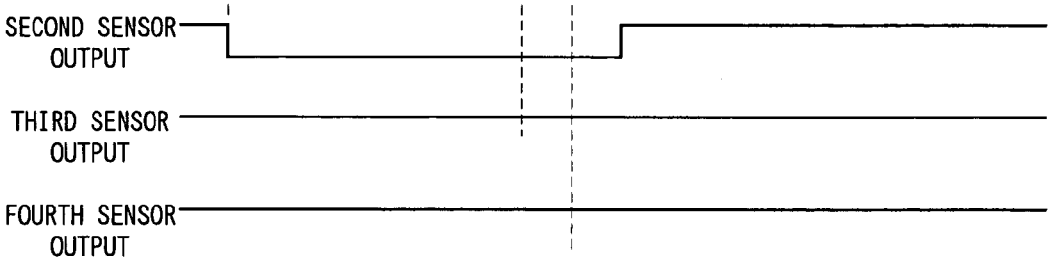
Figure 11A:
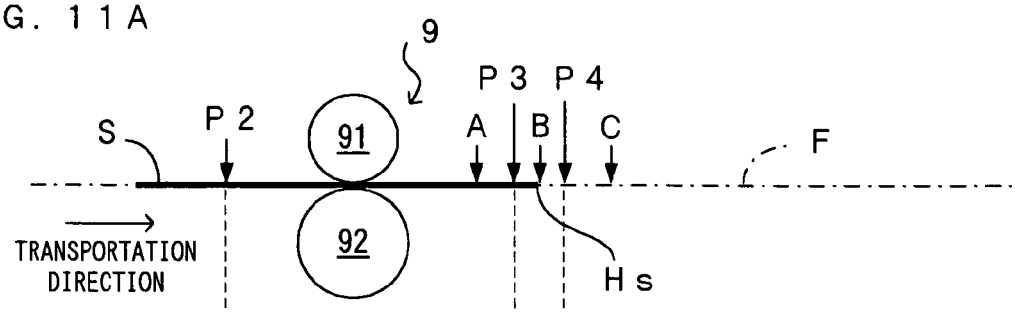
Figure 11B:
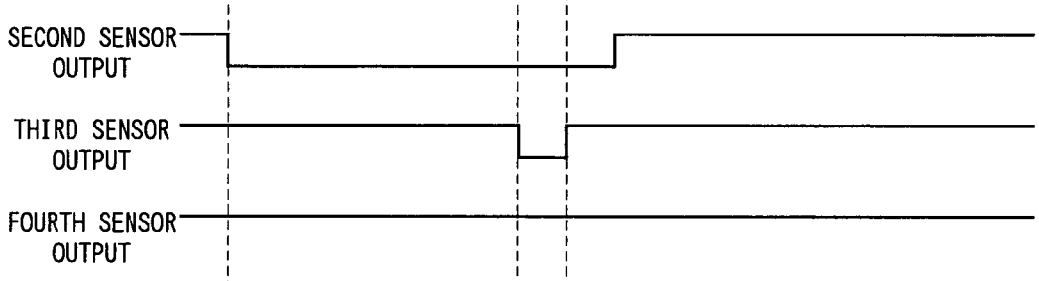
Figure 11C:
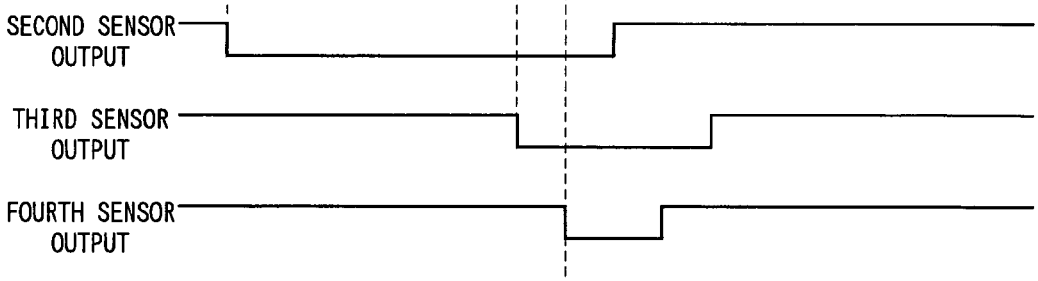
Figure 12A:
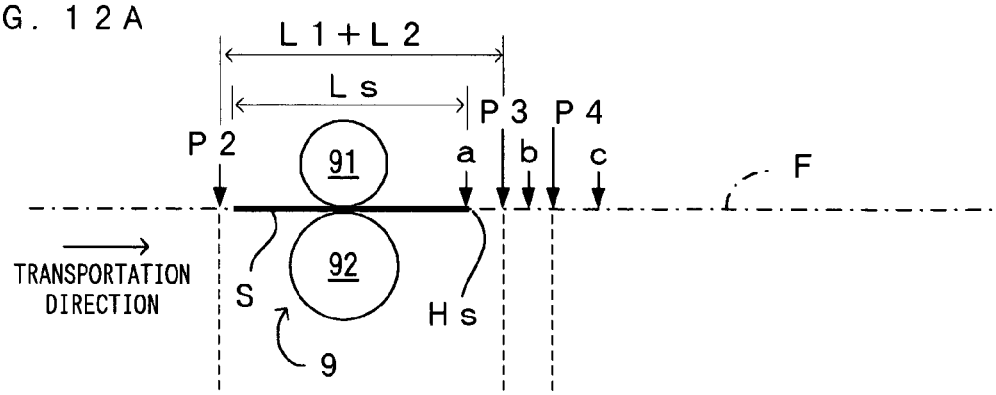
FIGS. 12A and 13A are drawings which show a positional relationship at the time of occurrence of a jam in the event that the length Ls of a sheet S is shorter than the gap between the positions P2 and P3.
Figure 12B:
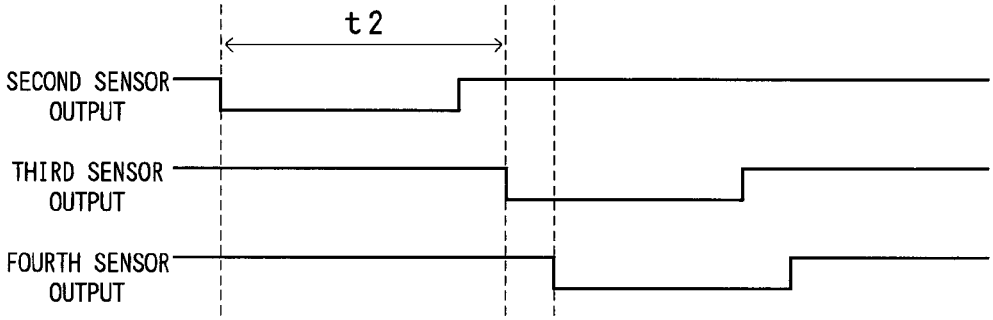
Figure 12C:
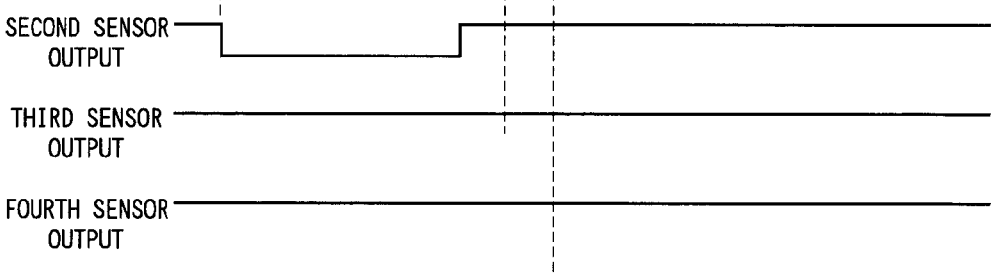
Figure 13A:
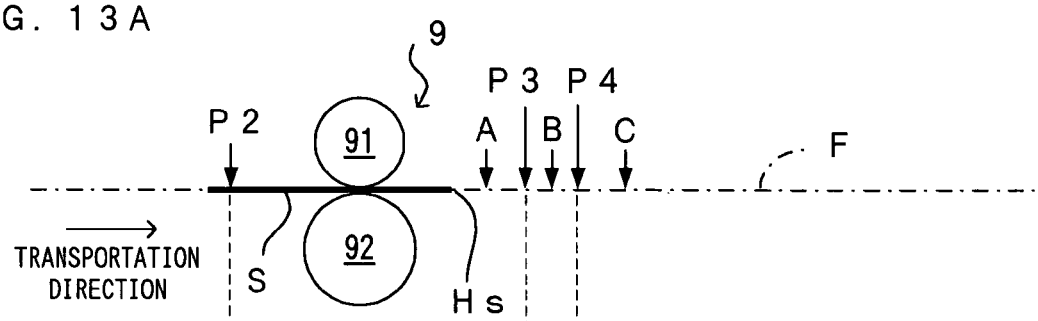

FIGS. 10A and 11A are drawings which show a positional relationship at the time of occurrence of a jam in the event that the length Ls of a sheet S is longer than the gap between the positions P2 and P3. FIGS. 12A and 13A are drawings which show a positional relationship at the time of occurrence of a jam in the event that the length Ls of a sheet S is shorter than the gap between the positions P2 and P3. Further, FIGS. 10B, 10C, 11B, 11C, 12B, 12C, 13B and 13C are drawings which show examples of the change pattern of the three sensor outputs.

(A) Ls≧(L1+L2)

(A-1) No Jam (Timing Chart: FIG. 10B)

In this case, as shown in FIG. 10A, first, the leading edge Hs of a sheet S which has been transported from the left-hand side moves passed the position P2. At this stage, as shown in FIG. 10B, the output signal from the second sensor 842 changes from the H-level to the L-level. The output signal from the second sensor 842 remains at the L-level while the sheet S is moving passed the position P2, but changes to the H-level once again after the trailing edge of the sheet S has moved passed the position P2.

As the leading edge Hs of the sheet S moves passed the position P3, the output signal from the third sensor 843 changes to the L-level. At this stage, the trailing edge of the sheet S has not yet moved passed the position P2. Hence, the second sensor output is then still at the L-level. As the sheet S moves further toward the right-hand side and the leading edge Hs of the sheet S arrives at the position P4, the output signal from the fourth sensor 844 changes to the L-level. As the trailing edge of the sheet S has moved passed the positions P2, P3 and P4, the output signals from the sensors 842, 843 and 844 return to the H-level. This is how the respective signals change normal transportation of a sheet S whose length Ls is longer than the gap between the positions P2 and P3.

As for a time t2 which a sheet S needs to reach the third detection position P3 after arriving at the second detection position P2, it is possible to calculate the time t2 in advance based on the gap between the detection positions (L1+L2) and the sheet transportation speed.

(A-2) A Jam at the Position A (Timing Chart: FIG. 10C)

This is an instance that a jam occurs while the sheet leading edge Hs is located between the nip area N and the position P3. This instance includes wrapping around at the leading edge of a sheet S. In this instance, as shown in FIG. 10C, the output signal from the second sensor 842 changes to the L-level as the sheet leading edge Hs moves passed the position P2. However, since the sheet S gets wrapped around the heater roller 91 before the leading edge Hs of the sheet S arrives at the position P3 after this, the sheet S will never arrive at the positions P3 and P4. Hence, the outputs from the sensors 843 and 844 will stay at the H-level without changing.

(A-3) A Jam at the Position B (Timing Chart: FIG. 11B)

This is an instance that a jam occurs while the sheet leading edge Hs is located between the positions P3 and P4 as shown in FIG. 11A. In this case, since the sheet leading edge Hs has already moved passed the positions P2 and P3, the outputs from the second sensor 842 and the third sensor 843 change from the H-level to the L-level one after another as shown in FIG. 11B. However, due to the occurrence of the jam, the sheet S gets wrapped around the heater roller 91 before the leading edge Hs of the sheet S arrives at the position P4, and the leading edge Hs moves passed the position P3 again although in the reverse direction this time. Due to this, the output from the third sensor 843 returns to the H-level without the output from the fourth sensor 844 changing to the L-level.

(A-4) A Jam at the Position C (Timing Chart: FIG. 11C)

This is an instance that a jam occurs after the sheet leading edge Hs has moved passed the position P4. In this instance, as shown in FIG. 11C, the respective outputs change to the L-level from the H-level temporarily after the sheet S has moved. Following this, due to the jam, the sheet leading edge Hs moves toward the left-hand side and moves passed the positions P4 and P3 in this order. Hence, at this stage, after the output from the fourth sensor 844 has returned to the H-level, the output from the third sensor 843 changes to the H-level.

(B) Ls<(L1+L2)

(B-1) No Jam (Timing Chart: FIG. 12B)

As shown in FIG. 12A, when the sheet length Ls is shorter than the gap (L1+L2) between the second detection position P2 and the third detection position P3, before the sheet leading edge Hs moving passed the position P2 and further moving toward the right-hand side arrives at the position P3, the trailing edge of a sheet S moves passed the position P2. Hence, as shown in FIG. 12B, while the output from the third sensor 843 changes to the L-level after the output from the second sensor 842 has changed to the L-level, the output from the second sensor 842 returns to the H-level before the output from the third sensor 843 changes. Meanwhile, the output from the fourth sensor 844 changes similarly to the output from the third sensor 843, with a certain delay in time.

(B-2) A Jam at the Position A (Timing Chart: FIG. 12C)

This instance is similar to the instance (A-2), except for that the output from the second sensor 842 stays at the L-level for a shorter time when the length of a sheet S is short. In short, as shown in FIG. 12C, while the output from the second sensor 842 remains at the L-level for a certain period of time, the outputs from the third sensor 843 and the fourth sensor 844 remain unchanged at the H-level.

Figure 13B:
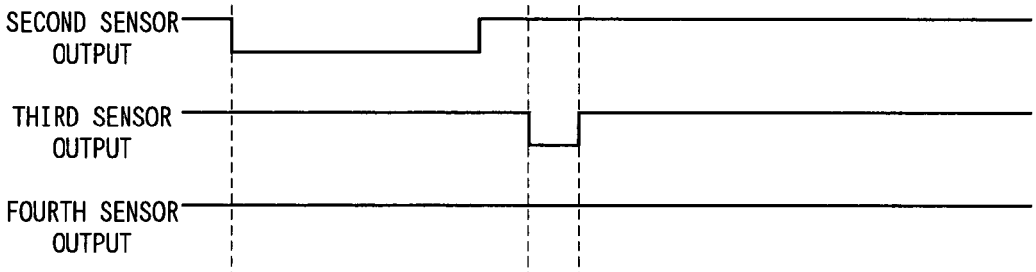

(B-3) A Jam at the Position B (Timing Chart: FIG. 13B)

In this instance, the leading edge Hs of a sheet S arrives at the position P3 after the trailing edge of the sheet S has moves passed the position P2. As the sheet S gets wrapped around the heater roller 91 after this, the leading edge Hs of the sheet S moves backward and moves passed the position P3 again without reaching the position P4. Hence, as shown in FIG. 13B, while the output from the third sensor 843 temporarily changes to the L-level and then returns to the H-level, during this, the output signal from the fourth sensor 844 remains at the H-level and would not change to the L-level.

Figure 13C:
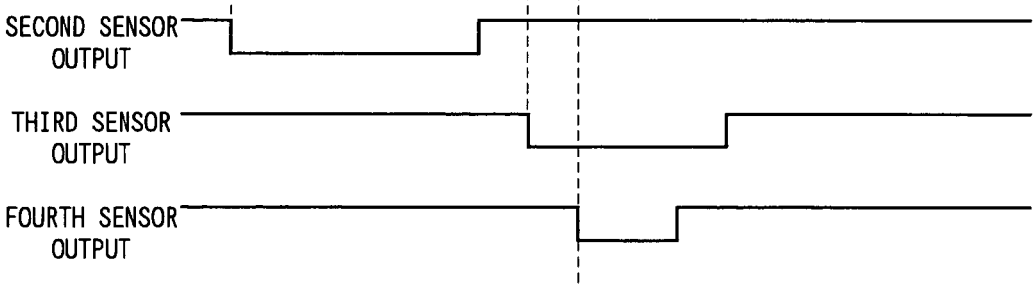

(B-4) A Jam at the Position C (Timing Chart: FIG. 13C)

In this case, the sheet leading edge Hs moves backward after moving passed the position P3. Because of this, as shown in FIG. 13C, the output from the fourth sensor 844 changes to the L-level after the output from the third sensor 843 has changed to the L-level, and following this, the output from the third sensor 843 returns to the H-level after the output from the fourth sensor 844 has returned to the H-level.

In light of this, according to this embodiment, the following four conditions are defined for the change pattern of the output signals from the sensors 842 through 844, and the CPU 101 determines whether a jam has occurred based on these conditions. That is, it is determined that there is no jam, i.e., a sheet S has been transported normally when the sensor outputs satisfy none of the conditions, but that a jam has occurred when the sensor outputs satisfies any one of the conditions.

Condition 1: During a period in which the output from the second sensor 842 remains successively at the L-level, the output from the third sensor 843 changes to the L-level from the H-level, and returns to the H-level once again during the same period.

Condition 2: During a period in which the output from the third sensor 843 remains successively at the L-level, the output from the fourth sensor 844 changes to the L-level from the H-level, and returns to the H-level once again during the same period.

Condition 3: The output from the fourth sensor 844 does not change to the L-level while the output from the third sensor 843 remains successively at the L-level.

Condition 4: The output from the third sensor 843 does not change to the L-level even after a certain period of time since a change of the output from the second sensor 842 to the L-level. The "certain period of time" referred to here corresponds to a time (the time t2 shown in FIG. 10B) which a sheet S transported at a predetermined transportation speed needs to move from the position P2 to the position P3, and as such, can be calculated in advance based on the sheet transportation speed and the gap between these two positions.

Thus, in this embodiment, the CPU 101 functions as the "jam judging means" of the present invention. The L-level signals outputted from the second through the fourth sensors correspond to "first through third detection signals" of the present invention. Further, the conditions 1 and 2 described above respectively correspond to a "first condition" and a "second condition" of the present invention.

In the manner described above, without any restriction imposed by the length of a sheet S, and as for any jam which has occurred at any one of the positions described above, it is possible to detect the jam without fail. For instance, of jams falling under these patterns above, as for the jam (A-2), the output signals from the respective sensors change as shown in FIG. 10C. Since these changes meet the condition 4 described above, it is judged that a jam has occurred. Meanwhile, when the jam (A-3) has occurred, the output signals from the respective sensors change as shown in FIG. 11B. Since these changes meet the conditions 1 and 3 described above, it is judged that a jam has occurred. As for jams of other patterns, since each sensor output changes while satisfying any one of the conditions 1 through 4, it is judged that a jam has occurred. On the contrary, when a sheet S has been transported normally, that is, when each sensor outputs changes as shown in FIG. 10B or 12B, none of the conditions described above is met, and it is therefore judged that no jam has occurred.

COMPARISON EXAMPLE

Figures 14A, 14B, 14C, 14D, 14E:
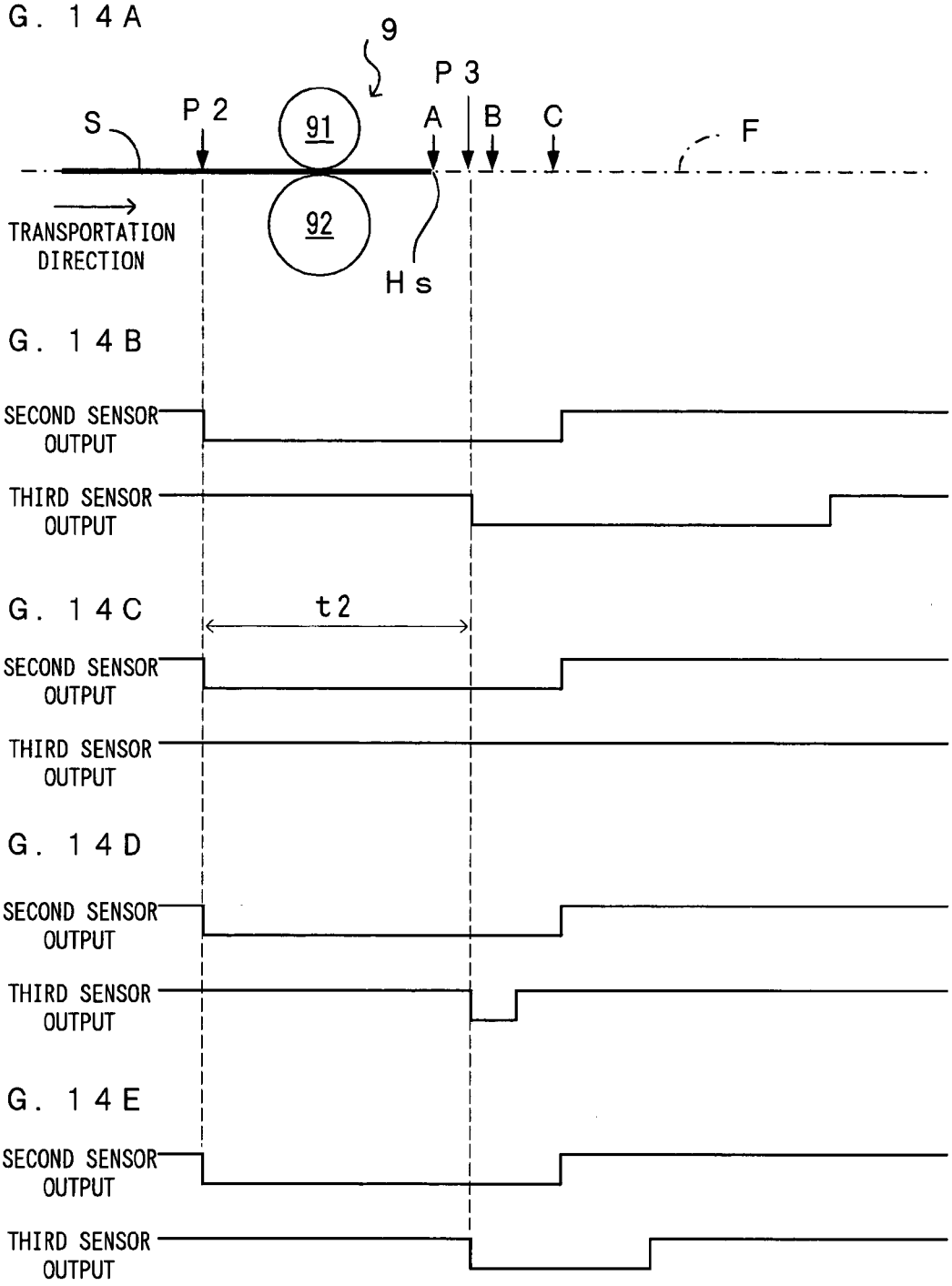
FIGS. 14A and 15A are drawings which show the arrangement of the sensors according to the conventional technique.
FIGS. 14B through 14E are timing charts which show the outputs from these two sensors in the event that the sheet length Ls is equal to or longer than the gap (L1+L2) between the sensors as shown in FIG. 14A.
Figure 15A:
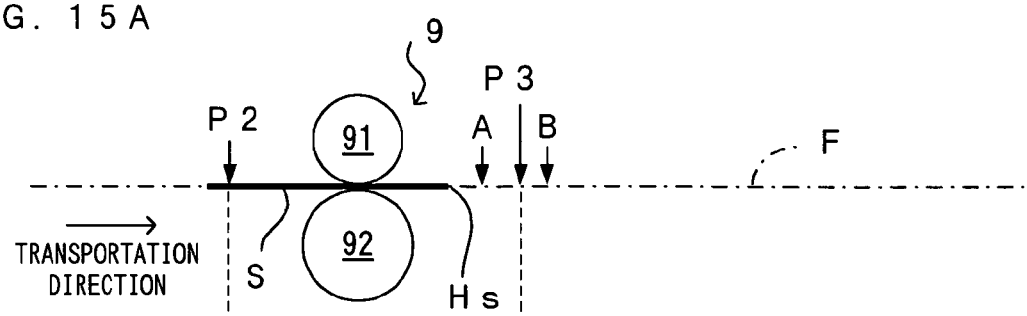

FIGS. 14A and 15A are drawings which show the arrangement of the sensors according to the conventional technique. In the preferred embodiments described above, a jam is detected based on outputs from one sensor which is disposed ahead of the fixing unit 9 along the sheet transportation direction and the two sensors which are disposed behind the fixing unit 9 along the sheet transportation direction. On the other hand, according to the conventional technique described earlier as a comparison example, a jam is detected based on output signals from the sensors which are disposed one ahead of and the other behind the fixing unit 9. This corresponds to jam detection by means of only outputs from the second and the third sensors in the image forming apparatus described above without disposing the fourth sensor 844. Hence, of the four conditions set in the preferred embodiment described above, the conditions 2 and 3 referring to the output from the fourth sensor 844 cannot be used.

Figure 15B:
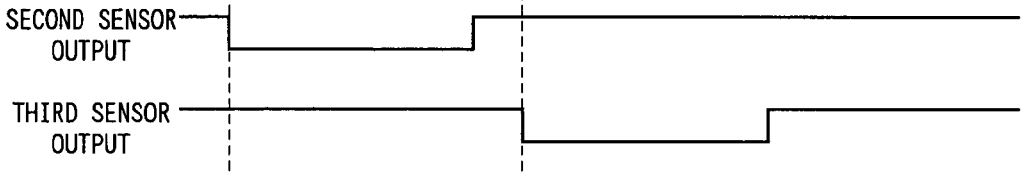
FIGS. 15B through 15D are timing charts which show the outputs from these two sensors in the event that the sheet length Ls is shorter than the gap (L1+L2) between the sensors as shown in FIG. 15A.
Figure 15C:
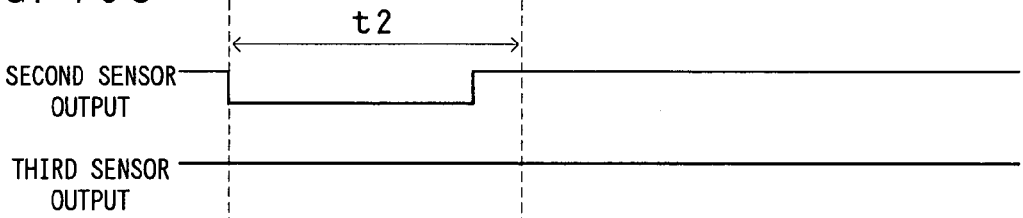
Figure 15D:
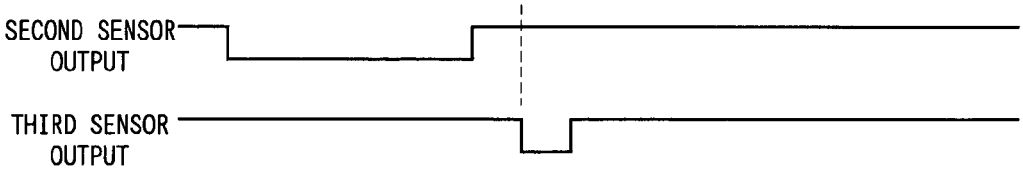

According to this conventional technique, the outputs from the second sensor 842 and the third sensor 843 change depending on the length of a sheet S and the location of the sheet leading edge Hs upon occurrence of a jam, as in the preferred embodiment described above. FIGS. 14B through 14E are timing charts which show the outputs from these two sensors in the event that the sheet length Ls is equal to or longer than the gap (L1+L2) between the sensors as shown in FIG. 14A. While corresponding respectively to normal transportation of a sheet S and occurrence of a jam with the sheet leading edge Hs located at the position A, B or C, these are merely the same as the patterns (A-1) through (A-4) described above as they are modified to omit the output from the fourth sensor 844. Meanwhile, FIGS. 15B through 15D are timing charts which show the outputs from these two sensors in the event that the sheet length Ls is shorter than the gap (L1+L2) between the sensors as shown in FIG. 15A. These also correspond to the patterns (B-1) through (B-3) described above as they are modified to omit the output from the fourth sensor 844.

As the foregoing has described, with only two sensor outputs, it is not possible to accurately detect a jam. For instance, while the pattern shown in FIG. 14D can be determined as a jam based on the condition 1, the pattern shown in FIG. 14E cannot be distinguished from the pattern shown in FIG. 14B. As a result, although a jam has occurred with the sheet leading edge Hs located at the position C, it is judged that no jam has occurred. In a similar fashion, it is not possible to distinguish the pattern shown in FIG. 15B from the pattern shown in FIG. 15D.

FIG. 16 is a drawing which compares a jam judgment result in this embodiment and that in the image forming apparatus of the comparison example. Of these, the mark "○" in the columns each for the conditions 1 through 4 denotes that the output pattern from the corresponding sensor meets the condition, while the mark "- " denotes that the output pattern from the corresponding sensor does not meet the condition. As for the column "JUDGEMENT RESULT," "○" corresponds to an instance that it is possible to correctly judge the absence or occurrence of a jam by means of a jam judgment referring to each condition while "x" corresponds to an instance that an erroneous judgment would be made. Thus, while there is a jam pattern which the apparatus of the comparison example cannot correctly detect, in the apparatus of this embodiment, it is possible to distinguish any jam pattern from a normal instance and correctly detect the jam.

That is, in this embodiment, referring to the condition 1, it is possible to detect the jam (A-3), i.e., a jam occurring when the sheet length Ls is longer than the gap between the positions P2 and P3 and the sheet leading edge Hs is located between the positions P3 and P4. Referring to the condition 2, it is possible to detect the jam (A-4) and the jam (B-4), i.e., jams occurring when the sheet leading edge Hs is located between the positions P3 and P4. Referring to the condition 3, it is possible to detect the jam (A-3) and the jam (B-3), i.e., jams occurring when the sheet leading edge Hs is located between the positions P3 and P4. Referring to the condition 4, it is possible to detect the jam (A-2) and the jam (B-2), i.e., jams occurring when the sheet leading edge Hs is located ahead of the position P2.

<Third Preferred Embodiment>

A third preferred embodiment of the image forming apparatus according to the present invention will now be described. In the third preferred embodiment, a jam is judged based on outputs from two sheet detection sensors which are disposed behind the fixing unit. This jam judging method is effective not only to such an apparatus which forms an image on only one surface of a sheet as that according to each preferred embodiment described above, but also to an apparatus which is capable of forming images on the both surfaces of a sheet.

Figure 17:
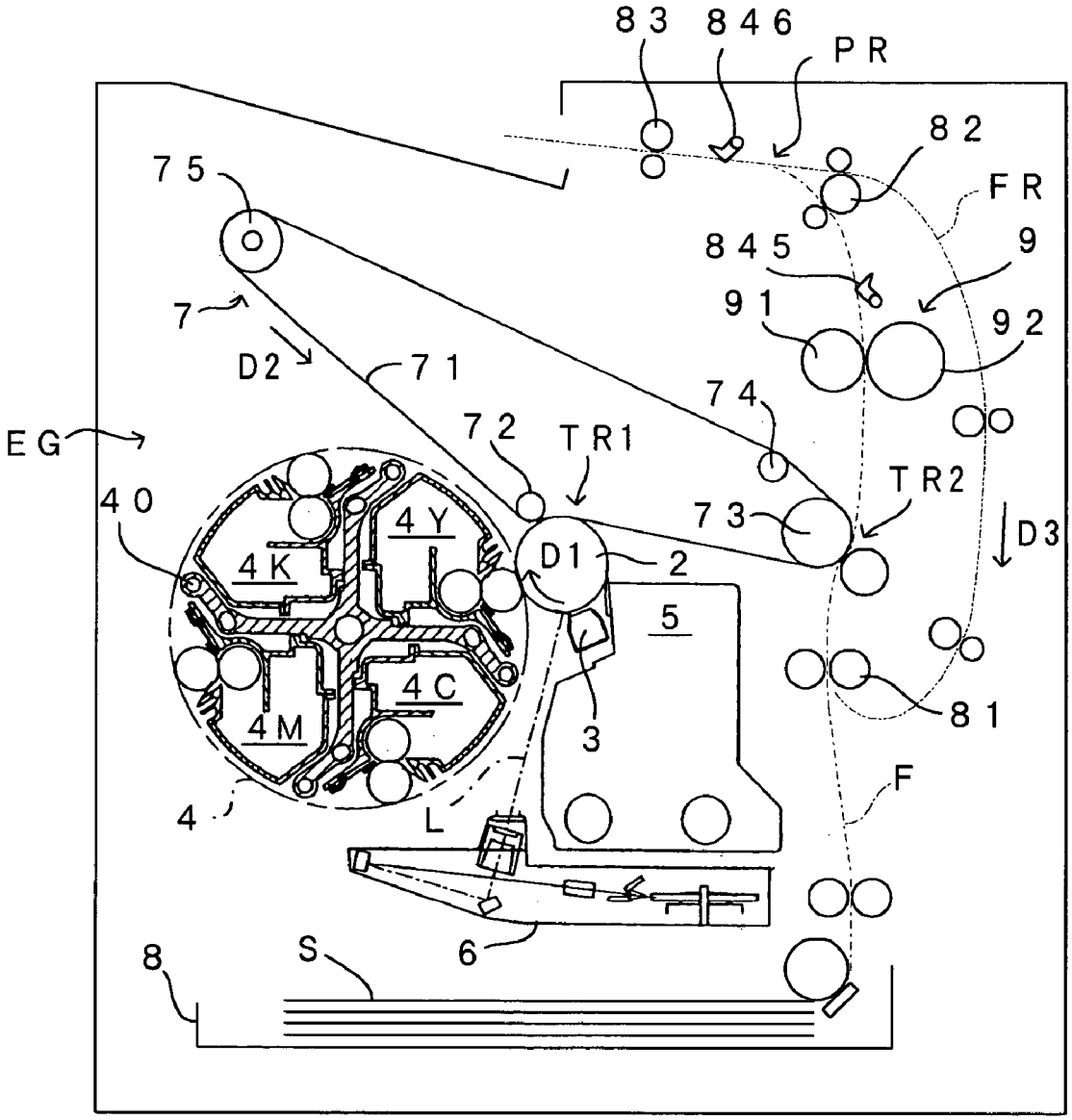
FIG. 17 is a drawing of the third preferred embodiment of the image forming apparatus according to the present invention.

FIG. 17 is a drawing of the third preferred embodiment of the image forming apparatus according to the present invention. As compared with the apparatus according to the second preferred embodiment (FIG. 8), the structure of the apparatus according to the third preferred embodiment is different in terms of the arrangement of the sheet detection sensors and in that there is a reverse transportation path FR.

In this apparatus, behind the fixing unit 9 on the transportation path F, there are a pre-discharge roller 82 and a discharge roller 83 which is capable of switching its rotation direction. When the discharge roller 83 reverses its rotation direction upon arrival of the trailing edge of a sheet S transported along the transportation path F at a reversing position PR, the sheet S is transported in the direction of the arrow D3 along the reverse transportation path FR. The sheet S then gets back on the transportation path F ahead of the gate roller 81. At this stage, the surface of the sheet S which abuts on the intermediate transfer belt 71 within the secondary transfer area TR2 and to which an image will be transferred to is the opposite surface to the surface to which the image has already been transferred. In consequence, images are formed on the both surfaces of the sheet S.

At a position behind the fixing unit 9 and a position behind the pre-discharge roller 82 on the transportation path F, as sheet detection sensors for detecting whether there are sheets S at these positions, a fifth sensor 845 and a sixth sensor 846 are disposed respectively which are formed by micro switches or photo-interrupters for example. These sensors 845 and 846 output the L-level when there are sheets S at the positions corresponding to these sensors on the transportation path F, but the H-level when there are not sheets S. These output signals are fed to the CPU 101. Hence, the CPU 101 can judge whether there are sheets S at these positions.

Figure 18A:
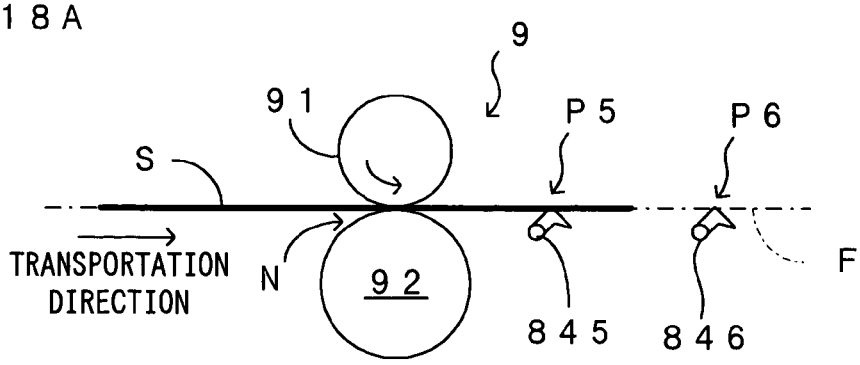
FIG. 18A is a drawing which shows a section around the fixing unit of the third preferred embodiment.
Figure 18B:
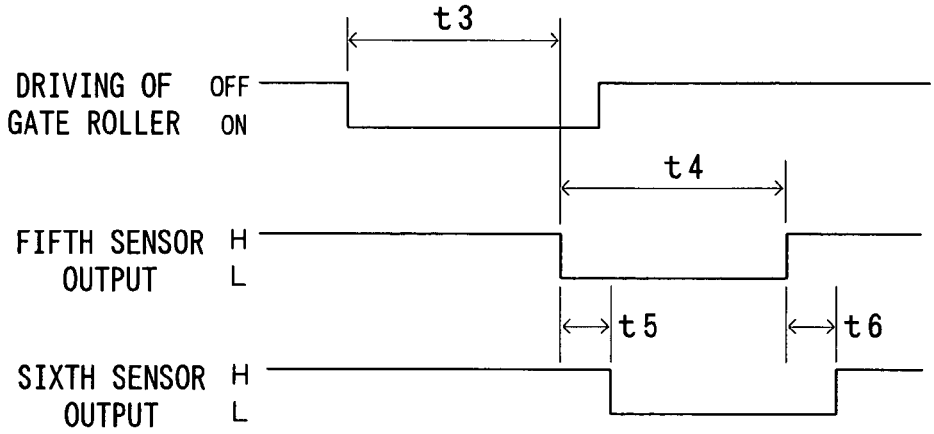
FIG. 18B is a timing chart of an example of output signals from the sheet detection sensors.
Figure 18C:
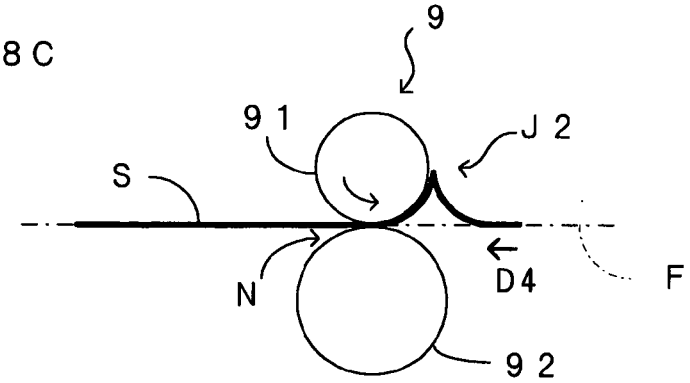
FIG. 18C is a drawing which shows an example how a sheet gets wrapped around the heater roller.

A method of detecting a jam which can occur in the fixing unit 9 of the image forming apparatus which has such a structure will now be described in detail. FIG. 18A is a drawing which shows a section around the fixing unit of the third preferred embodiment, while FIG. 18B is a timing chart of an example of output signals from the sheet detection sensors. FIG. 18C is a drawing which shows an example how a sheet gets wrapped around the heater roller. In the illustrate example, it is assumed that the length of a sheet S is longer than the gap between these two sensors 845 and 846 on the transportation path F.

Normal transportation of a sheet S will now be considered. As the leading edge of the sheet S sent out from the fixing unit 9 reaches a position P5 where is disposed the fifth sensor 845, an output signal from the sensor 845 changes to the L-level from the H-level. As described earlier, the sheet S starts moving toward the secondary transfer area TR2 as the gate roller 81 rotates. Hence, as shown in FIG. 18B, after a certain period of time t3 from turning on of the gate roller 81, the output from the fifth sensor 845 should change to the L-level. The output from the fifth sensor 845 returns to the H-level after the trailing edge of the sheet S has moved passed the position P5. A period of time t4 during which the output from the fifth sensor 845 remains successively at the L-level is dependent upon the length of the sheet S.

Meanwhile, when a leading edge portion of the sheet S arrives at a position P6 which is further behind the position P5, an output signal from the sixth sensor 846 changes to the L-level from the H-level. A time difference t5 since the change of the output from the fifth sensor 845 to the L-level has a value which corresponds to the gap between these two sensors. After the trailing edge of the sheet S moves passed the position P6, the output from the sixth sensor 846 also returns to the H-level. At this stage, a time difference t6 since the change of the output from the fifth sensor 845 to the H-level has approximately the same value as that of the time difference t5.

The output signals from the two sensors change as described above in the event that the sheet S has been transported normally and has moved passed the positions P5 and P6. However, upon occurrence of a jam, the sensor outputs behave differently from above. For example, upon occurrence of the jam J2 shown in FIG. 18C, since a sheet S gets wrapped around the heater roller 91, the leading edge of the sheet S which is supposed to move toward the right-hand side in the drawing moves toward the left-hand side, i.e., along the direction of the arrow D4. The conditions of the outputs from the sensors 845 and 846 at this stage are different depending where the leading edge of the sheet S has been located at the time of the jam J2.

Figure 19A:
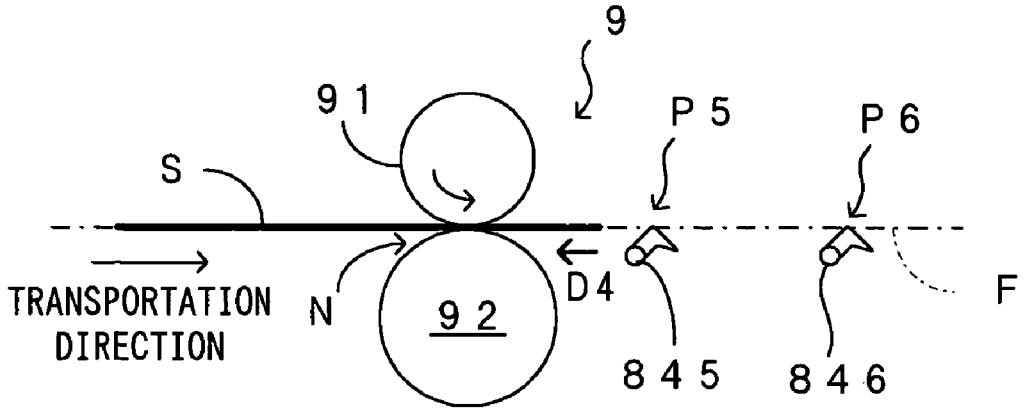
FIG. 19A is a drawing which shows an instance that a jam has occurred when a leading edge portion of a sheet S is located between the nip area N and the position P5.
Figure 20A:
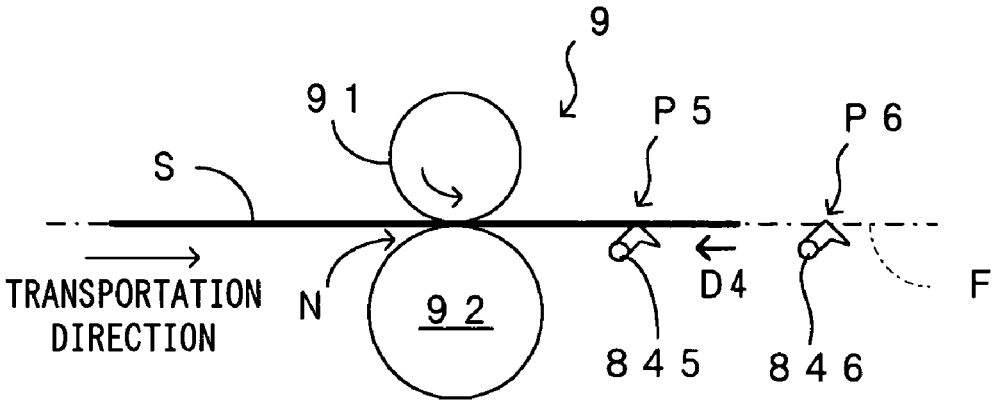
FIG. 20A is a drawing which shows an instance that a jam has occurred when a leading edge portion of a sheet S is located between the position P5 and the position P6.
Figure 21A:
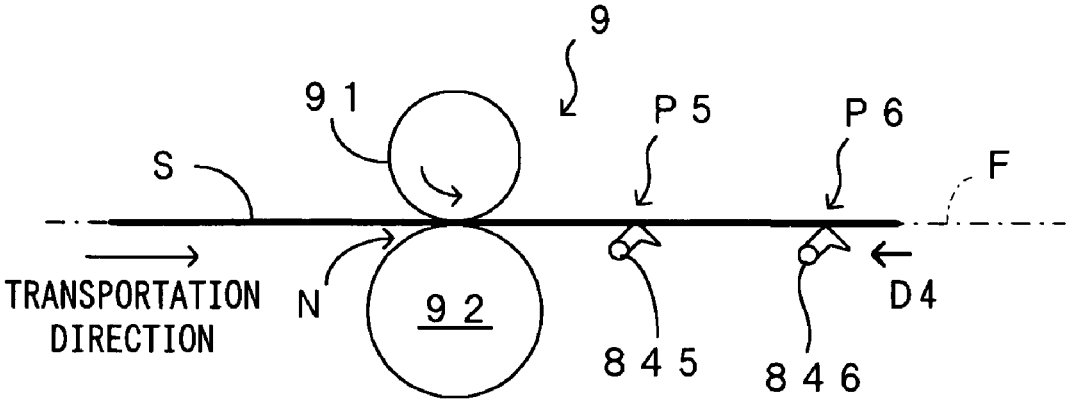
FIG. 21A is a drawing which shows an instance that a jam has occurred when a leading edge portion of a sheet S is located ahead of the position P6.

FIG. 19A is a drawing which shows an instance that a jam has occurred when a leading edge portion of a sheet S is located between the nip area N and the position P5. FIG. 20A is a drawing which shows an instance that a jam has occurred when a leading edge portion of a sheet S is located between the position P5 and the position P6. FIG. 21A is a drawing which shows an instance that a jam has occurred when a leading edge portion of a sheet S is located ahead of the position P6.

Figure 19B:
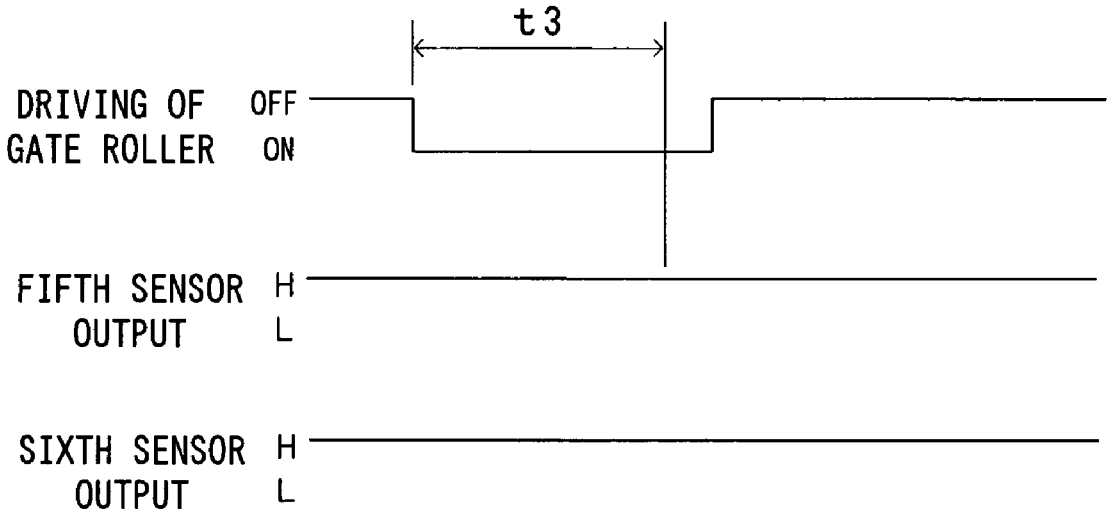
FIG. 19B is a timing chart which shows an example of output signals from the sheet detection sensors.

First, a jam shown in FIG. 19A will now be considered which occurs as a sheet S gets wrapped around the heater roller 91 when the leading edge of the sheet S is located between the nip area N and the position P5. FIG. 19B is a timing chart which shows an example of output signals from the sheet detection sensors. This instance includes wrapping around at the leading edge of a sheet S. In this instance, as shown in FIG. 19B, since a jam has occurred before the leading edge portion of the sheet S arrive at the position P5, the output from the fifth sensor 845 stays at the H-level even after the time t3 from turning on of the gate roller 81. Hence, in the event that the output from the fifth sensor 845 fails to change to the L-level even after the time t3 from turning on of the gate roller 81, it is considered that a jam has occurred.

Figure 20B:
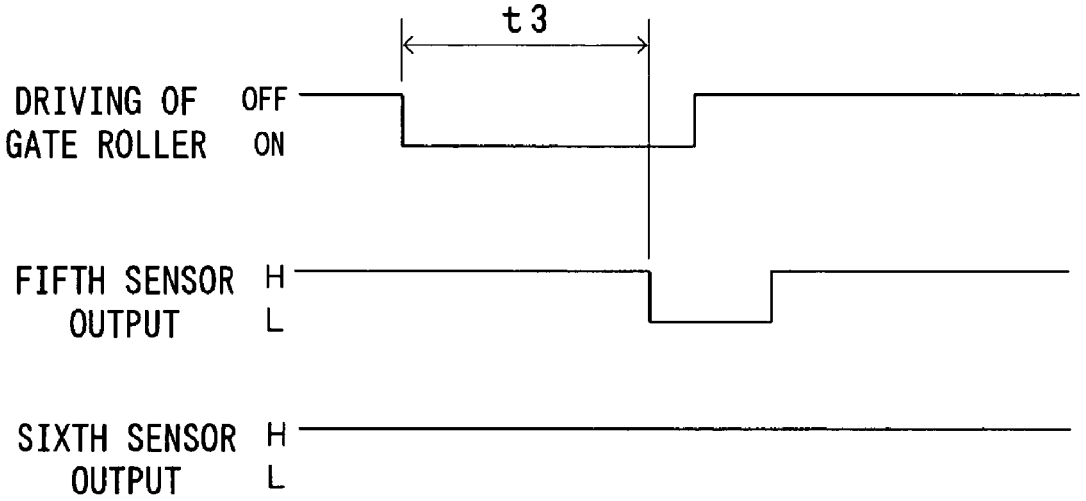
FIG. 20B is a timing chart which shows an example of output signals from the sheet detection sensors.

Next, a jam shown in FIG. 20A will now be considered which occurs when a leading edge portion of a sheet S is located between the position P5 and the position P6. FIG. 20B is a timing chart which shows an example of output signals from the sheet detection sensors. In this instance, since the leading edge portion of the sheet S has already moved passed the position P5, as shown in FIG. 20B, the output from the fifth sensor 845 temporarily changes to the L-level. However, as the leading edge portion of the sheet S moves backward in the direction of the arrow D4 and moves passed the position P5 once again, the output from the fifth sensor 845 changes to the H-level. Since the sheet S does not reach the position P6 during this, the output from the sixth sensor 846 remains at the H-level. Hence, when the output from the sixth sensor 846 fails to change to the L-level before the output from the fifth sensor 845 returns to the H-level after changing to the L-level, it is considered that a jam has occurred. Also when a jam has occurred at the pre-discharge roller 82 which is disposed between the two sensors 845 and 846, the outputs from the respective sensors exhibit similar patterns to those described above.

Further, a jam shown in FIG. 21A will now be considered which occurs when a leading edge portion of a sheet S is located on the discharge tray side beyond the position P6.

Figure 21B:
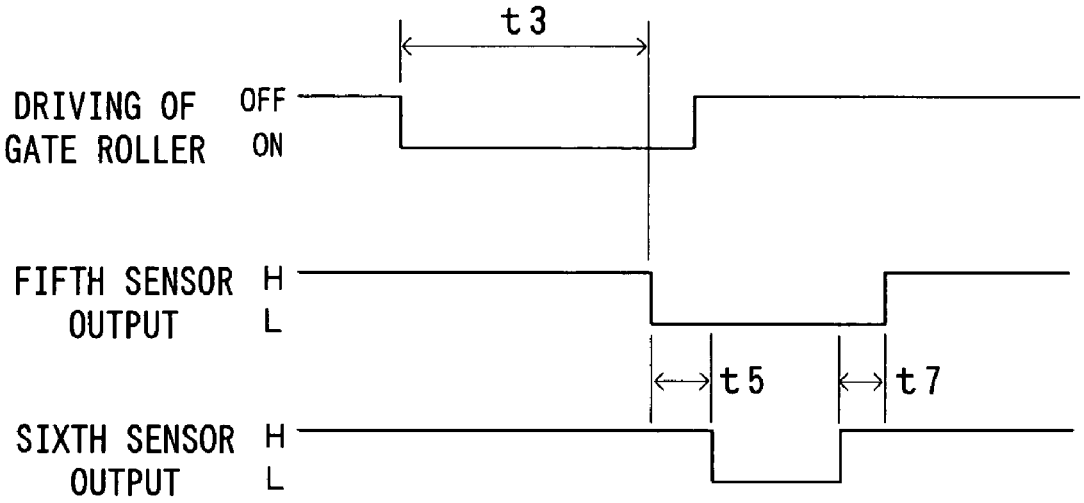
FIG. 21B is a timing chart which shows an example of output signals from the sheet detection sensors.

FIG. 21B is a timing chart which shows an example of output signals from the sheet detection sensors. In this instance, since the leading edge portion of the sheet S has already moved passed both the positions P5 and P6, as shown in FIG. 21B, the output from the fifth sensor 845 changes to the L-level after the time t3 from turning on of the gate roller 81, and the output from the sixth sensor 846 then changes to the L-level after a time t5 from this. However, as the sheet S moves reversely in the direction of the arrow D4 from this state, the leading edge portion of the sheet S first moves passed the position P6 and then the position P5. In short, the output from the sixth sensor 846 returns to the H-level first, and further after a time t7, the output from the fifth sensor 845 returns to the H-level. Hence, it is considered that a jam has occurred when a series of changes have been observed that the output from the sixth sensor 846 has returned to the H-level after changing to the L-level while the output from the fifth sensor 845 has remained successively at the L-level.

Thus, in the case of the length of a sheet S is longer than the gap between the positions P5 and P6, when changes of the output signals from the two sensors 845 and 846 match with any one of the patterns described above, it is considered that a jam has occurred. On the contrary, when the sheet S is shorter than this gap, a jam is detected in the following manner.

Figure 22A:
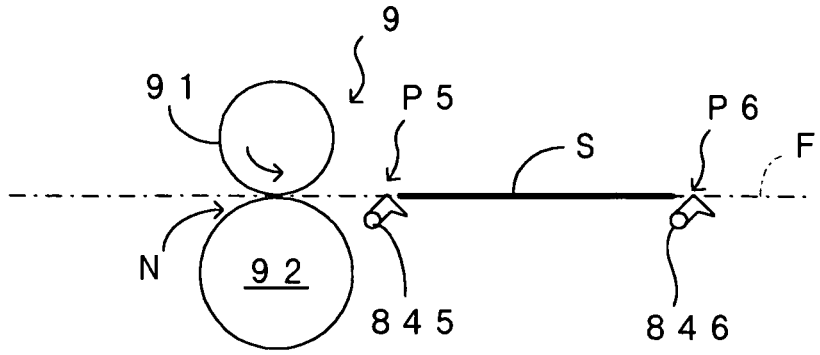
FIGS. 22A, 22B and 22C are drawings which show the principles of jam detection of a short sheet.
Figure 22B:
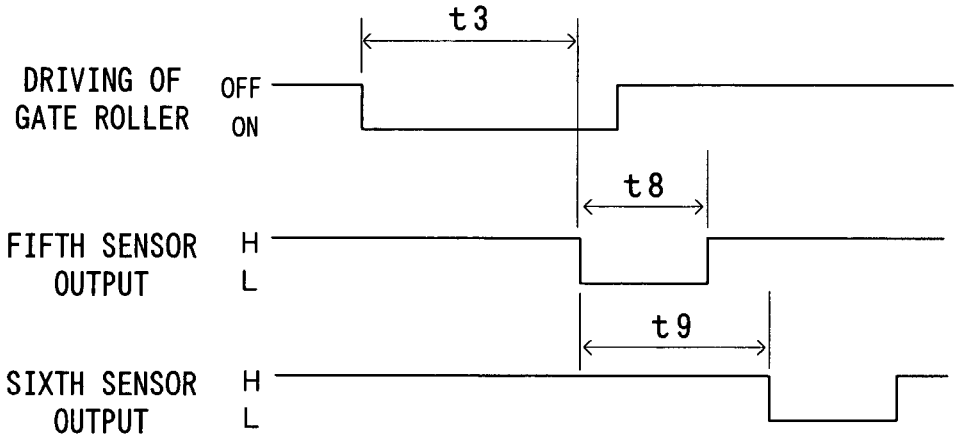
Figure 22C:
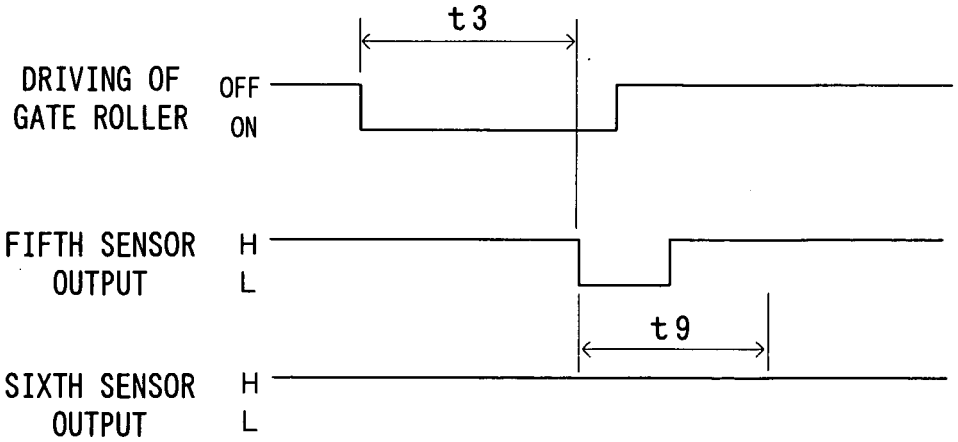

FIGS. 22A, 22B and 22C are drawings which show the principles of jam detection of a short sheet. As shown in FIG. 22A, when a sheet S which is shorter than the gap between the two detection positions P5 and P6 is used, the trailing edge of the sheet S moves passed the position P5 before the leading edge of the sheet S arrives at the position P6. Hence, the sheet S has been transported normally, as shown in FIG. 22B, after the output from the fifth sensor 845 has changed to the L-level and then returned to the H-level as the sheet S has passed, the output from the sixth sensor 846 changes to the L-level. In other words, the output from the sixth sensor 846 does not change to the L-level while the output from the fifth sensor 845 returns to the H-level again after changing to the L-level. Since this leads to acknowledgement of a jam with the jam detecting method described above, this problem is solved by the following manner.

An actual circumstance for a jam of such a sheet S at the fixing unit is either that the leading edge of the sheet S is ahead of the position P5 or between the positions P5 and P6. As for the former pattern, since the output from the fifth sensor 845 does not change to the L-level even after the time t3 from turning on of the gate roller 81, it is possible to detect a jam with the jam detecting method described above.

Meanwhile, as for the latter pattern, it is possible to detect a jam as described below. That is, since the sheet transportation speed and the gap between the sensors 845 and 846 are known, during a period of time in which the sheet S has been transported normally and the leading edge of the sheet S arrives at the position P6 after moving passed the position P5, namely, a time t9 shown in FIG. 22B can be generally predicted. However, upon occurrence of a jam, since the sheet S would not reach the position P6, if the output from the sixth sensor 846 fails to change to the L-level even after the predicted time t9, it is considered that a jam has occurred. The time t9 corresponds to the time t5 in FIG. 18B.

This jam detecting method can be applied independently of the length of a sheet S. The reason is as follows. The time t9 shown in FIG. 22B is a period of time until the leading edge of a sheet S arrives at the position P6 after moving passed the position P5. The time t9 is determined by the gap between the two positions and the sheet transportation speed between the two positions, and irrelevant to the length of a sheet S. Hence, even when the length of a sheet S is unknown, it is possible to detect a jam by this method. Meanwhile, a period of time t8 during which the output from the fifth sensor 845 and the sixth sensor 846 is maintained at the L-level becomes different depending on the length of a sheet S.

Noting this, in this embodiment, the CPU 101 determines occurrence of a jam in the following fashion based on the output signals from the fifth sensor 845 and the sixth sensor 846.

First, in the event that the length of a sheet S is known and longer than the gap between the two sensors 845 and 846, it is judged that a jam has occurred when any one of the following conditions 5 through 8 is met.

Condition 5: The output from the fifth sensor 845 does not change to the L-level even after a predetermined time since the start of driving of the gate roller 81 (FIG. 19B).

Condition 6: The output from the sixth sensor 846 does not change to the L-level during a period of time in which the output from the fifth sensor 845 returns to the H-level after changing to the L-level, that is, while the fifth sensor 845 keeps outputting the L-level (FIG. 20B).

Condition 7: The output from the sixth sensor 846 does not change to the L-level even after a predetermined time since the output from the fifth sensor 845 has changed to the L-level (FIG. 22C).

Condition 8: The output from the sixth sensor 846 changes to the L-level and then returns to the H-level while the fifth sensor 845 keeps outputting the L-level (FIG. 21B).

Further, when the length of a sheet S is known, it is possible to grasp periods of time needed to move passed the positions P5 and P6 (i.e., the t3 shown in FIG. 18B and the time t8 shown in FIG. 22B) in advance, and hence, the following condition 9 may be added.

Condition 9: A period of time during which the output signal from the fifth sensor 845 or the sixth sensor 846 is continuously at the L-level is different from the time set corresponding to the length of a sheet S.

The "predetermined time" referred to in each condition may be set based on positional relationships between the respective portions of the apparatus such as the gap between the two sensors, the sheet transportation speed, the length of a sheet S, etc. It is preferable to set each "predetermined time" for each condition considering variations of these values.

When the length of a sheet S is unknown or shorter than the gap between the two sensors 845 and 846, the conditions 6 and 9 described above are not used.

Thus, in this embodiment, there are the two sensors behind the fixing unit 9 on the transportation path F, i.e., the fifth sensor 845 and the sixth sensor 846. Based on the output signals from these sensors, the CPU 101 detects occurrence of a jam of a sheet S in the fixing unit 9. In other words, the fifth sensor 845 and the sixth sensor 846 function respectively as "first detection means" and "second detection means" of the present invention and the CPU 101 functions as the "jam judging means" of the present invention in this embodiment. Further, the positions P5 and P6 respectively correspond to a "first detection position" and a "second detection position" of the present invention, while the L-level output signals among the outputs from the fifth sensor 845 and the sixth sensor 846 respectively correspond to a "first detection signal" and a "second detection signal" of the present invention. In this manner, regardless the length of a sheet S and even when sheet S has got wrapped in various different ways, it is possible to detect a jam without fail as described above.

While this image forming apparatus is capable of forming images on the both surfaces of a sheet (hereinafter referred to as "double sided printing"), a sheet S moves differently from the above during execution of double sided printing, and therefore, the outputs from the two sensors change differently from the above.

Figure 23A:
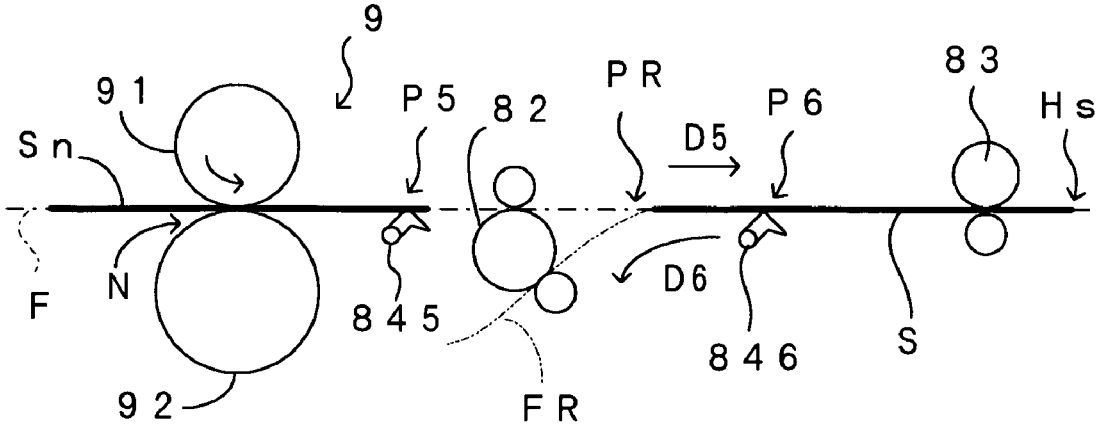
FIGS. 23A, 23B and 23C are drawings which show operations during execution of double sided printing.
Figure 23B:
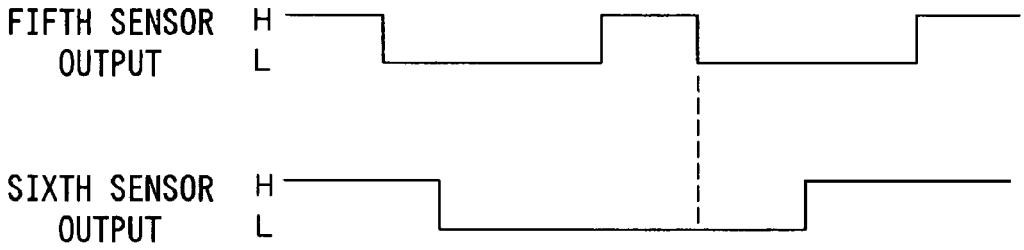
Figure 23C:
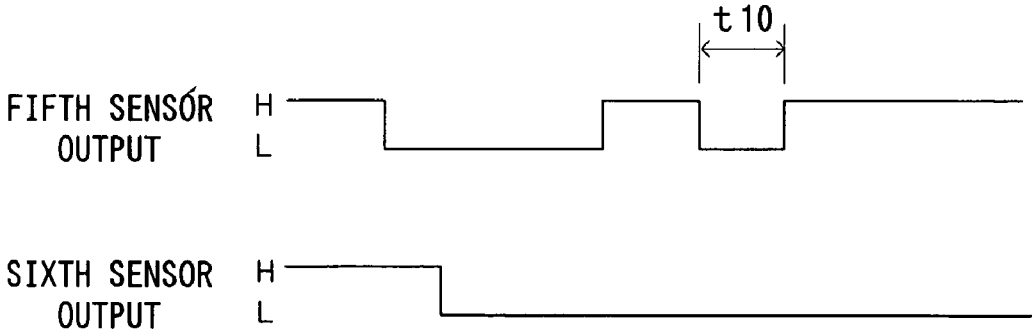

FIGS. 23A, 23B and 23C are drawings which show operations during execution of double sided printing. During execution of double sided printing, as shown in FIG. 23A, after a sheet S has been transported in the direction of the arrow D5 and the trailing edge of the sheet S has arrived reversing position PR, the rotation direction of the discharge roller 83 is reversed and the sheet S is accordingly transported in the direction of the arrow D6 along the reverse transportation path FR. Hence, the output from the sixth sensor 846 changes to the L-level when a leading edge portion Hs of the sheet S moving in the direction D5 has just moved passed the position P6, and returns to the H-level when a trailing edge portion Hs of the sheet S moving backward in the direction D6 has just moved passed the position P6 once again.

Therefore, the duration in which the signal outputted from the sensor 846 as one sheet S moves passed is kept at the L-level may become different from that during forming of an image only on one side described earlier. However, since the change pattern of the output signals from the sensors 845 and 846 is basically similar to those described above, it is possible to detect occurrence of a jam in a similar fashion.

However, an operation sequence is sometimes designed such that an image is formed on the next sheet Sn in parallel to feeding of one sheet S along the reverse transportation path FR, to thereby shorten the processing time while images are successively formed on a plurality of sheets. Depending the design therefore, the next sheet Sn could arrive at the position P5 before a trailing edge portion Hs of the sheet S transported along the reverse transportation path FR moves passed the position P6.

In this case, as shown in FIG. 23B, while the output signal from the sensor 845 changes to the L-level intermittently as a plurality of sheets move passed this sensor, the output signal from the sensor 846 changes to the L-level consecutively. When this happens, of the conditions described earlier, it is desirable to detect a jam based on the conditions 5 and 9. For example, as shown in FIG. 23C, when a time t10 during which the output from the sensor 845 stays at the L-level as a sheet Sn has moved passed the position P5 is shorter than the predicted passing time which has been calculated in advance from the length of the sheet Sn, it is considered that the sheet has got wrapped around the heater roller 91 after a leading edge portion of the sheet has moved passed the position P5.

<Modifications>

The present invention is not limited to the preferred embodiments above, but may be modified in various manners in addition to the preferred embodiments above, to the extent not deviating from the object of the invention. For instance, although the preferred embodiments described above are directed to an application of the present invention to a fixing unit in which a sheet S is transported while applying heat and pressure upon the sheet S and toner on the surface of the sheet S, applications of the present invention are limited to the fixing unit 9. For example, the gate roller 81, the intermediate transfer belt 71, which transports a sheet S in the predetermined direction toward the fixing unit 9 while transferring an image on a sheet S within the secondary transfer area TR2, and the like have a function as the "transportation means" of the present invention. Since these elements could cause a jam as a sheet S gets wrapped around them, when the present invention is applied to these elements, it is possible to quickly detect a jam at each of these elements.

In addition, although the preferred embodiments above have not described, some countermeasures against noises or chattering may be implemented for each sensor output to thereby stabilize the operations and prevent an erroneous judgment for instance. Such measure is realized for example by interposing a buffer having a Schmitt trigger characteristic on a signal line between each sensor and the CPU 101.

Further, although the preferred embodiments above are directed to an image forming apparatus which comprises only one cassette 8, the present invention may be applied to an image forming apparatus which comprises a plurality of cassettes. In the case of the sheets of different sized from each other may be held in different cassettes and the apparatus allows a selective use of sheets having a certain size among these sizes in accordance with the size of an image to be formed or in accordance with a user's wish, at the time of forming an image, the reference time ts and the like described earlier may be determined in accordance with the size of an actual sheet which is to be used.

Still further, although the preferred embodiments above are directed to an image forming apparatus which is capable of forming a full-color image using toner of four colors, the present invention is not limited only to such an apparatus but is applicable also to an image forming apparatus which comprises only a developer corresponding to black color toner and forms a monochrome image for instance. Moreover, while the preferred embodiments above are directed to an image forming apparatus which serves as a printer which forms an image corresponding to an image signal fed from a host computer, the present invention may be applied also to other image forming apparatuses such as a copier machine and a facsimile machine.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

transportation means which transports a sheet-like recording medium along a predetermined transportation path;

first detection means which outputs a predetermined first detection signal when said recording medium is located at a first detection position which is behind said transportation means in the transportation direction of transporting said recording medium;

jam judging means which measures the duration of said first detection signal, and based on a result of a comparison of the measurement result with a reference time which is set in accordance with the length of said recording medium along said transportation path, judges whether a jam of said recording medium has occurred; and length detection means which is disposed ahead of said transportation means on said transportation path and which detects the length of said recording medium along said transportation path, wherein said reference time is set based on a detection result obtained by said length detection means.

2. An image forming apparatus, comprising:

transportation means which transports a sheet-like recording medium along a predetermined transportation path;

first detection means which outputs a predetermined first detection signal when said recording medium is located at a first detection position which is behind said transportation means in the transportation direction of transporting said recording medium; and jam judging means which measures the duration of said first detection signal, and based on a result of a comparison of the measurement result with a reference time which is set in accordance with the length of said recording medium along said transportation path, judges whether a jam of said recording medium has occurred;

wherein said transportation means is a fixing unit which fixes an unfixed image on said recording medium.

3. A jam detecting method for use in an image forming apparatus comprising transportation means which is for transporting a sheet-like recording medium along a predetermined transportation path, said method comprising the steps of:

setting a reference time in accordance with the length of said recording medium along said transportation path;

measuring the duration of a first detection signal that first detection means, which is disposed at a first detection position which is behind said transportation means in the transportation direction of transporting said recording medium, outputs when said recording medium is located at said first detection position;

detecting, by length detection means disposed ahead of said transportation means on said transportation path, the length of said recording medium along said transportation path; and comparing the measured duration with said reference time and judging whether a jam of said recording medium has occurred based on the comparison result;

wherein said reference time is set based on a detection result obtained by said length detection means.

4. An image forming apparatus, comprising:

transportation means which transports a sheet-like recording medium along a predetermined transportation path;

first detection means which outputs a first detection signal when a recording medium moves past a first detection position which is ahead of said transportation means in the recording medium transportation direction;

second detection means which outputs a second detection signal when a recording medium moves past a second detection position which is behind said transportation means in the recording medium transportation direction;

third detection means which outputs a third detection signal when a recording medium moves past a third detection position which is behind said second detection position in the recording medium transportation direction; and jam judging means which judges that a jam of said recording medium has occurred, when at least one of a first condition and a second condition below is satisfied:

the first condition being a condition that during a period in which outputting of said first detection signal has been continuing since the start of the outputting of said first detection signal, outputting of said second detection signal has started, and during the same period, the outputting of said second detection signal ends, the second condition being a condition that during a period in which outputting of said second detection signal has been continuing since the start of the outputting of said second detection signal, outputting of said third detection signal has started, and during the same period, the outputting of said third detection signal ends.

5. The image forming apparatus of claim 4, wherein the gap between said second detection position and said third detection position along said transportation path is shorter than the length of said recording medium in the recording medium transportation direction, and in the absence of said third detection signal during continuous outputting of said second detection signal since the start of the outputting of said second detection signal, said jam judging means judges that a jam of said recording medium has occurred.

6. The image forming apparatus of claim 4, wherein in the absence of said second detection signal after a certain period of time, which has been set in advance in accordance with the gap between said first and said second detection positions, since the start of outputting of said first detection signal, said jam judging means judges that a jam of said recording medium has occurred.

7. The image forming apparatus of any one of claim 4, wherein said transportation means is a fixing unit which fixes an unfixed image on said recording medium.

8. A jam detecting method for use in an image forming apparatus comprising transportation means which is for transporting a sheet-like recording medium along a predetermined transportation path, said method comprising the steps of:

detecting whether said recording medium is present each at first through third detection positions, said first detection position being behind said transportation means in the recording medium transportation direction, said second detection position being behind said transportation means in the recording medium transportation direction, and said third detection position being behind said second detection position in the recording medium transportation direction; and judging that a jam of said recording medium has occurred when at least one of a first condition and a second condition below is satisfied:

the first condition being a condition that during continuous detection of the presence of said recording medium at said first detection position, the detection result at said second detection position changes to one indicative the presence of said recording medium from one indicative the absence of said recording medium, and then changes to one indicative the absence of said recording medium again, the second condition being a condition that during continuous detection of the presence of said recording medium at said second detection position, the detection result at said third detection position changes to one indicative the presence of said recording medium from one indicative the absence of said recording medium, and then changes to one indicative the absence of said recording medium again.

9. An image forming apparatus, comprising:

transportation means which transports a sheet-like recording medium along a predetermined transportation path;

first detection means which outputs a first detection signal when a recording medium moves past a first detection position which is behind said transportation means in the recording medium transportation direction;

second detection means which outputs a second detection signal when a recording medium moves past a second detection position which is behind said first detection position in the recording medium transportation direction; and jam judging means which judges whether a jam of said recording medium has occurred, based on output signals from said first and said second detection means;

wherein the gap between said first and said second detection positions is shorter than the length of said recording medium in the recording medium transportation direction, and in the absence of said second detection signal during outputting of said first detection signal since the start of the outputting of said first detection signal, said jam judging means judges that a jam of said recording medium has occurred.

10. An image forming apparatus, comprising:

transportation means which transports a sheet-like recording medium along a predetermined transportation path;

first detection means which outputs a first detection signal when a recording medium moves past a first detection position which is behind said transportation means in the recording medium transportation direction;

second detection means which outputs a second detection signal when a recording medium moves past a second detection position which is behind said first detection position in the recording medium transportation direction; and jam judging means which judges whether a jam of said recording medium has occurred, based on output signals from said first and said second detection means;

wherein the gap between said first and said second detection positions is shorter than the length of said recording medium in the recording medium transportation direction, and when outputting of said second detection signal has started during a period in which outputting of said first detection signal has been continuing since the start of the outputting of said first detection signal and when the outputting of said second detection signal has ended during the same period, said jam judging means judges that a jam of said recording medium has occurred.

11. An image forming apparatus, comprising:

transportation means which transports a sheet-like recording medium along a predetermined transportation path;

first detection means which outputs a first detection signal when a recording medium moves past a first detection position which is behind said transportation means in the recording medium transportation direction;

second detection means which outputs a second detection signal when a recording medium moves past a second detection position which is behind said first detection position in the recording medium transportation direction; and jam judging means which judges whether a jam of said recording medium has occurred, based on output signals from said first and said second detection means;

wherein said transportation means is a fixing unit which fixes an unfixed image borne by said recording medium on said recording medium.

12. A jam detecting method for use in an image forming apparatus comprising transportation means which is for transporting a sheet-like recording medium along a predetermined transportation path, said method comprising the steps of:

outputting, by a first detection means, a first detection signal when said recording medium moves past a first detection position which is behind said transportation means in the recording medium transportation direction;

outputting, by a second detection means, a second detection signal when the recording medium moves past a second detection position which is behind said first detection position in the recording medium transportation direction;

judging whether a jam of said recording medium has occurred, based on output signals from said first and second detection means;

wherein the gap between the first and second detection means is shorter than the length of said recording medium in the recording medium transportation direction, and wherein a jam of said recording medium is judged to have occurred when outputting of said second detection signal has started during a period in which outputting of said first detection signal has been continuing since the start of the outputting of said first detection signal and when outputting of said second detection signal has ended during the same period.

* * * * *